US006037922A

United States Patent [19]

Yagyu

[11] Patent Number: 6,037,922

[45] Date of Patent: Mar. 14, 2000

[54] OPTICAL MODULATION OR IMAGE DISPLAY SYSTEM

[75] Inventor: Mineto Yagyu, Sagamihara, Japan

[73] Assignee: Canon Kabushiki Kaisha, Tokyo, Japan

[21] Appl. No.: 08/661,958

[22] Filed: Jun. 12, 1996

[30] Foreign Application Priority Data

| | | | |
|---|---|---|---|
| Jun. 15, 1995 | [JP] | Japan | 7-148793 |
| Jun. 16, 1995 | [JP] | Japan | 7-150280 |
| Jun. 26, 1995 | [JP] | Japan | 7-159428 |

[51] Int. Cl.[7] ..... G09G 3/36

[52] U.S. Cl. ..... 345/89; 349/25

[58] Field of Search ..... 345/4, 6, 87, 96; 349/25, 31; 365/108; 353/31; 348/739

[56] References Cited

U.S. PATENT DOCUMENTS

| | | | |
|---|---|---|---|
| 4,048,628 | 9/1977 | Boswell | 365/108 |
| 4,191,456 | 3/1980 | Hong et al. | 353/31 |
| 4,239,345 | 12/1980 | Berreman et al. | 350/331 R |
| 4,709,995 | 12/1987 | Kuribayashi et al. | 350/350 S |
| 4,712,877 | 12/1987 | Okada et al. | 350/350 |
| 4,747,671 | 5/1988 | Takahashi et al. | 350/336 |
| 4,763,994 | 8/1988 | Kaneko et al. | 350/336 |
| 4,796,980 | 1/1989 | Kaneko et al. | 350/350 |
| 5,053,679 | 10/1991 | Thioulouse | 345/4 |
| 5,120,466 | 6/1992 | Katagiri et al. | 252/299.01 |
| 5,170,271 | 12/1992 | Lackner et al. | 349/25 |
| 5,172,257 | 12/1992 | Patel | 359/84 |
| 5,189,536 | 2/1993 | Hanyu et al. | 359/56 |
| 5,311,206 | 5/1994 | Nelson | 345/89 |
| 5,359,345 | 10/1994 | Hunter | 345/102 |
| 5,379,136 | 1/1995 | Hu et al. | 349/31 |
| 5,543,862 | 8/1996 | Culkin | 348/739 |
| 5,696,525 | 12/1997 | Kanbe et al. | 345/96 |
| 5,748,162 | 5/1998 | Hanami | 345/87 |
| 5,825,337 | 10/1998 | Wiseman et al. | 345/6 |

FOREIGN PATENT DOCUMENTS

| | | |
|---|---|---|
| 0361981 | 4/1990 | European Pat. Off. . |
| 0453033 | 10/1991 | European Pat. Off. . |
| 0569029 | 11/1993 | European Pat. Off. . |
| 56-88193 | 7/1981 | Japan . |
| 2162673 | 2/1986 | United Kingdom . |
| WO 89/06852 | 7/1989 | WIPO . |

*Primary Examiner*—Steven J. Saras
*Assistant Examiner*—Alecia D. Nelson
*Attorney, Agent, or Firm*—Fitzpatrick, Cella, Harper & Scinto

[57] ABSTRACT

An optical modulation unit is constituted by a light source periodically turned on, and an optical modulation means including an optical modulation element and periodically turned on. The optical modulation unit is driven by changing a voltage applied to the optical modulation element depending on given graduation data so as to modulate an overlapping time between an ON period of the optical modulation means and a lighting period of the light source. The gradation data may be analog gradation data and may be carried by light illuminating the optical modulation element synchronized with a voltage applied to the optical modulation element.

62 Claims, 21 Drawing Sheets

OPTICAL MODULATION OR IMAGE DISPLAY SYSTEM

FIELD OF THE INVENTION AND RELATED ART

The present invention relates to a method and an apparatus or system for driving an optical modulation or image display device or unit of the type controlling the quantity of light issued from a light source and transmitted or reflected thereby.

An optical modulation device is included in various optical apparatus, such as a display apparatus. Gradational display or gray-scale display is performed by using such an optical modulation device, for example according to various schemes as will be described hereinbelow with reference to a liquid crystal display device as a familiar example.

Accordingly to one scheme, a twisted nematic (TN) liquid crystal is used as an optical modulation element (substance) constituting pixels and a voltage data is applied to the TN-liquid crystal to modulate (control) the transmittance through a whole pixel.

According to a second scheme, one pixel is composed as an assemblage of plural sub-pixels so that each sub-pixel is turned on or off based on binary data to modulate the area of sub-pixels placed in a light-transmission state. This scheme is disclosed, e.g., in Japanese Laid-Open Patent Application (JP-A) 56-88193, European Laid-Open Patent Application (EP-A) 453033 and EP-A 361981.

According to a third scheme, one pixel is provided with a distribution of electric field intensity or inversion threshold of liquid crystal so that a bright state portion and a dark state portion are co-present in a varying areal ratio to modulate the transmittance through the pixel. This scheme is disclosed in U.S. Pat. No. 4,796,980 issued to Kaneko, et al and entitled "Ferroelectric liquid crystal optical modulation device with regions within pixels to initiate nucleation and inversion", and U.S. Pat. Nos. 4,712,877, 4,747,671, 4,763,994, etc.

According to a fourth scheme, the period of one pixel being turned-on to show a bright state is modulated. This scheme is disclosed in U.S. Pat. No. 4,709,995 issued to Kuribayashi, et al and entitled "Ferroelectric display panel and display method therefor to activate gray scale".

Another example of digital duty modulation is disclosed in U.S. Pat. No. 5,311,206 issued to Nelson and entitled "Active row backlight column shutter LCD with one shutter transition per row".

Herein, the first scheme is referred to as brightness modulation; the second scheme, pixel division; the third scheme, domain modulation; and the fourth scheme, digital duty modulation.

The brightness modulation is not readily applicable to a device using an optical modulation substance having a steep transmittance change characteristic or a memory characteristic. Further, the brightness modulation using a TN-liquid crystal is not suitable for a system dealing with data varying at high speeds because the TN-liquid crystal generally has a low response speed.

The pixel division equivalent to a system using a unit pixel comprising an assemblage of pixels is caused to have a lower spatial frequency, thus being liable to result in a lower resolution. Further, the area of light-interrupting portion is increased to lower the aperture ratio.

The domain modulation requires a pixel of complicated structure for providing a distribution of electric field intensity or inversion threshold. Further, as the voltage margin for halftone display is narrow, the performance is liable to be affected by the temperature.

The digital duty modulation requires an ON-OFF time modulation so that the modulation unit time is limited by the clock pulse frequency and gate-switching time. Accordingly, it is difficult to effect a high-accuracy modulation and the number of displayable gradation levels is limited. Further, this scheme necessarily requires an analog-to-digital (A/D) conversion of analog data so that it cannot be readily applied to a simple optical modulation system.

SUMMARY OF THE INVENTION

In view of the above-mentioned problems, an object of the present invention is to provide an optical modulation or image display system (i.e., method and apparatus) allowing optical modulation based on analog data.

Another object of the present invention is to provide an optical modulation or image display system applicable to an optical modulation device using an optical modulation substance having a steep applied voltage-transmittance (V-T) characteristic or an optical modulation substance having a memory characteristic.

A further object of the present invention is to provide an optical modulation or image display system capable of realizing a high spatial frequency and a high resolution.

Another object of the present invention is to provide an optical modulation or image display system which allows gradational data reproduction according a relatively simple scheme based on analog duty modulation and is thus inexpensive.

According to the present invention, there is provided a driving method for an optical modulation unit including a light source periodically turned on, and an optical modulation means including an optical modulation element and periodically turned on, the driving method comprising: changing a voltage applied to the optical modulation element depending on given graduation data so as to modulate an overlapping time between an ON period of the optical modulation means and a lighting period of the light source.

According to another aspect of the present invention, there is provided an optical modulation apparatus, comprising:

a light source periodically turned on, an optical modulation means including an optical modulation element and periodically turned on, and drive means for driving the optical modulation means by changing a voltage applied to the optical modulation element depending on given graduation data so as to modulate an overlapping time between an ON period of the optical modulation means and a lighting period of the light source.

According to another aspect of the present invention, there is provided a driving method for an optical modulation unit including a light source periodically turned on, and an optical modulation means comprising a plurality of optical modulation elements arranged in plane each periodically turned on; the driving method comprising: changing a voltage applied to each optical modulation element depending on given gradation data so as to modulate an overlapping time between an ON period of the optical modulation element and a lighting period of the light source.

The plurality of optical modulation elements can be replaced by a planar optical modulation element so that a voltage applied to a local region of the planar optical modulation element is changed depending on given gradation data.

According to another aspect of the present invention, there is provided a driving method for an optical modulation unit including an optical modulation device comprising a pair of electrodes, and a photoelectric conversion layer and an optical modulation element disposed between the pair of electrodes, a signal light source for supplying light data carrying gradation data to the photoelectric conversion layer, and a readout light source for supplying readout light to the optical modulation element; the driving method comprising: controlling a lighting time of the readout light source to modulate an overlapping time between a period of the optical modulation element assuming a prescribed optical state and the lighting time depending on given gradation data.

According to another aspect of the present invention, there is provided a driving method for driving an optical modulation unit including a light source and an optical modulation means comprising an optical modulation element; the driving method comprising:

applying a voltage changing with time depending on given gradation data to the optical modulation element, thereby modulating a point of time when the optical modulation element is switched from a first optical state to a second optical state, and turning on the light source to obtain light data subjected to duty modulation depending on the gradation data.

According to another aspect of the present invention, there is provided a driving method for an optical modulation unit including a light source, and an optical modulation means comprising an optical modulation element assuming bistable states, a photoelectric conversion substance and a pair of electrode sandwiching the optical modulation element and the photoelectric conversion substance; the driving method comprising:

applying a voltage between the pair of electrodes, and supplying light data carrying gradation data to the photoelectric conversion substance so as to apply a voltage changing with time depending on the gradation data to the optical modulation substance, thereby modulating a period from switching from a first stable state to a second stable state to switching from the second stable state to the first stable state respectively, of the optical modulation substance, the period being modulated within a range having a maximum set to be shorter than a prescribed period so as to allow recognition of a change in gradation level.

According to another aspect of the present invention, there is provided a driving method for an optical modulation unit including a light source, and an optical modulation means comprising an optical modulation element, a photoelectric conversion substance and a pair of electrode sandwiching the optical modulation element and the photoelectric conversion substance; the driving method comprising:

applying a voltage between the pair of electrodes, supplying light data carrying gradation data to the photoelectric conversion substance so as to apply a voltage changing with time depending on the gradation data to the optical modulation substance, thereby modulating a time point of switching from a first optical state to a second optical state, and turning on the light source so as to provide a lighting time within a range having a maximum period set to be shorter than a prescribed period so as to allow recognition of a change in gradation level.

According to another aspect of the present invention, there is provided a driving method for an optical modulation unit including a light source, and an optical modulation means comprising an optical modulation element, a photoelectric conversion substance and a pair of electrode sandwiching the optical modulation element and the photoelectric conversion substance; the driving method comprising:

repetitively applying a voltage between the pair of electrodes, the voltage causing a polarity inversion and having a DC component of substantially zero within a prescribed period, supplying light data carrying gradation data to the photoelectric conversion substance, and applying a voltage changing with time depending on the gradation data to the optical modulation element to modulate a time point of switching from a first optical state to a second optical state of the optical modulation element, thereby turning on the light source in either a former half or a latter half of the prescribed period.

According to another aspect of the present invention, there is provided a driving method for the image display unit including an optical modulation device comprising a pair of electrodes for application of a voltage therebetween, and a photoconductor layer and an optical modulation element disposed between the pair of electrodes; a signal light source for supplying light information carrying gradation data to the photoconductor layer; and a readout light source for supplying readout light for reading out image data to the optical modulation element; the driving method comprising:

operating the readout light source in a lighting period controlled to be different from a period of supplying the light information, thereby modulating an overlapping time between a period of the optical modulation element assuming a prescribed optical state and the lighting period depending on the gradation data.

In the present invention, a point or period of time when a voltage applied to an optical modulation element exceeds a threshold for switching an optical state of the optical modulation element is changed in an analog mode depending on given gradation data. As a result, a length of overlapping time between the ON time of an optical modulation means, i.e., the period of opening of an optical shutter, and the lighting period of a light source, is modulated in an analog mode so that the time integration of the transmitted or reflected light quantity corresponds to the gradation data. Thus, the number of gradation levels is not restricted by a digital quantity, such as clock pulse frequency, and the A/D conversion of gradation data can be omitted.

Further, analog modulation becomes possible even by using a digital (or binary) display device having a steep applied voltage-transmittance characteristic, as an effect which cannot be expected heretofore.

Thus, good gradational display becomes possible according to the present invention.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First of all, a basic modulation scheme according to the present invention will be described with reference to the drawings.

Figure 1:
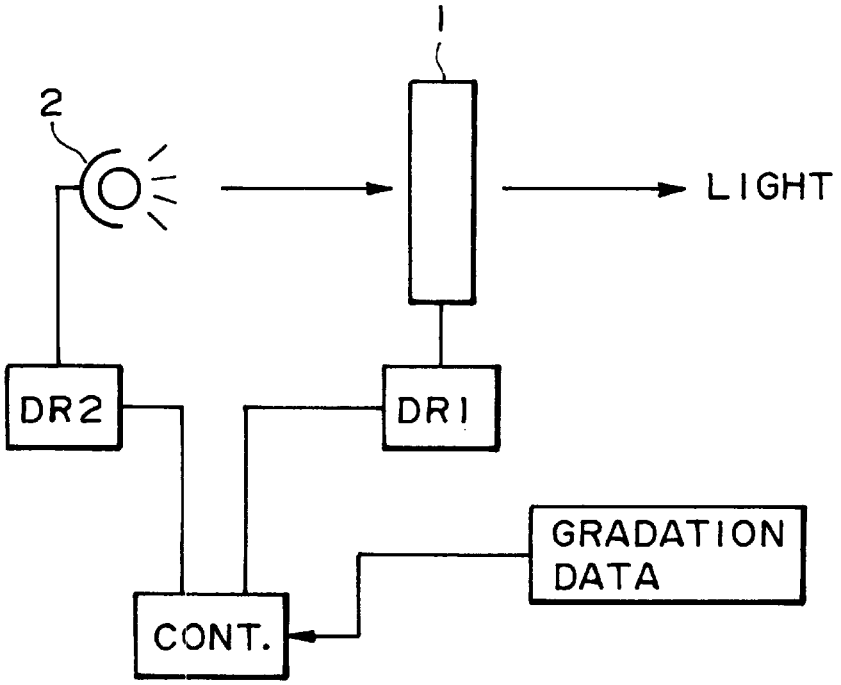
FIG. 1 is a block diagram showing a basic arrangement of an optical modulation system according to the invention.

FIG. 1 is a diagram of an embodiment of system for realizing the modulation scheme according to the present invention. The system includes an optical shutter 1 for controlling light transmission as an optical modulation means, a light source 2 for emitting light, a drive means DR1 for driving the optical shutter, a drive means DR2 for turning on and off the light source, and a control means CONT for controlling power supplies to and operation time of the two drive means.

Figure 2:
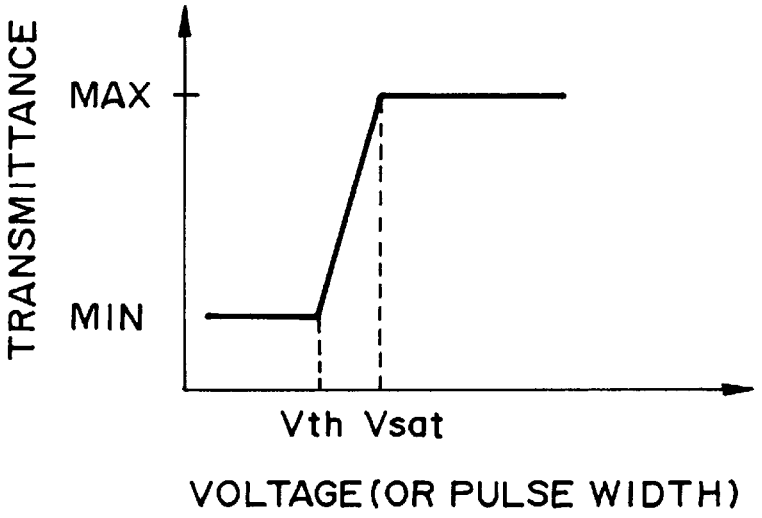
FIG. 2 is a graph showing an applied voltage (or pulse width)-dependent transmittance characteristic of an optical modulation element (or substance) used in the invention.

FIG. 2 is a graph showing an example of transmittance change characteristic of an optical modulation element (substance) constituting the optical shutter 1. For example, when an applied voltage of a constant pulse width exceeds a threshold Vth, a transmittance is caused to abruptly increase to be a constant value above a saturation voltage Vsat. If the optical modulation substance has a memory characteristic, the resultant optical state is retained at constant even after removal of the applied voltage.

Figure 3:
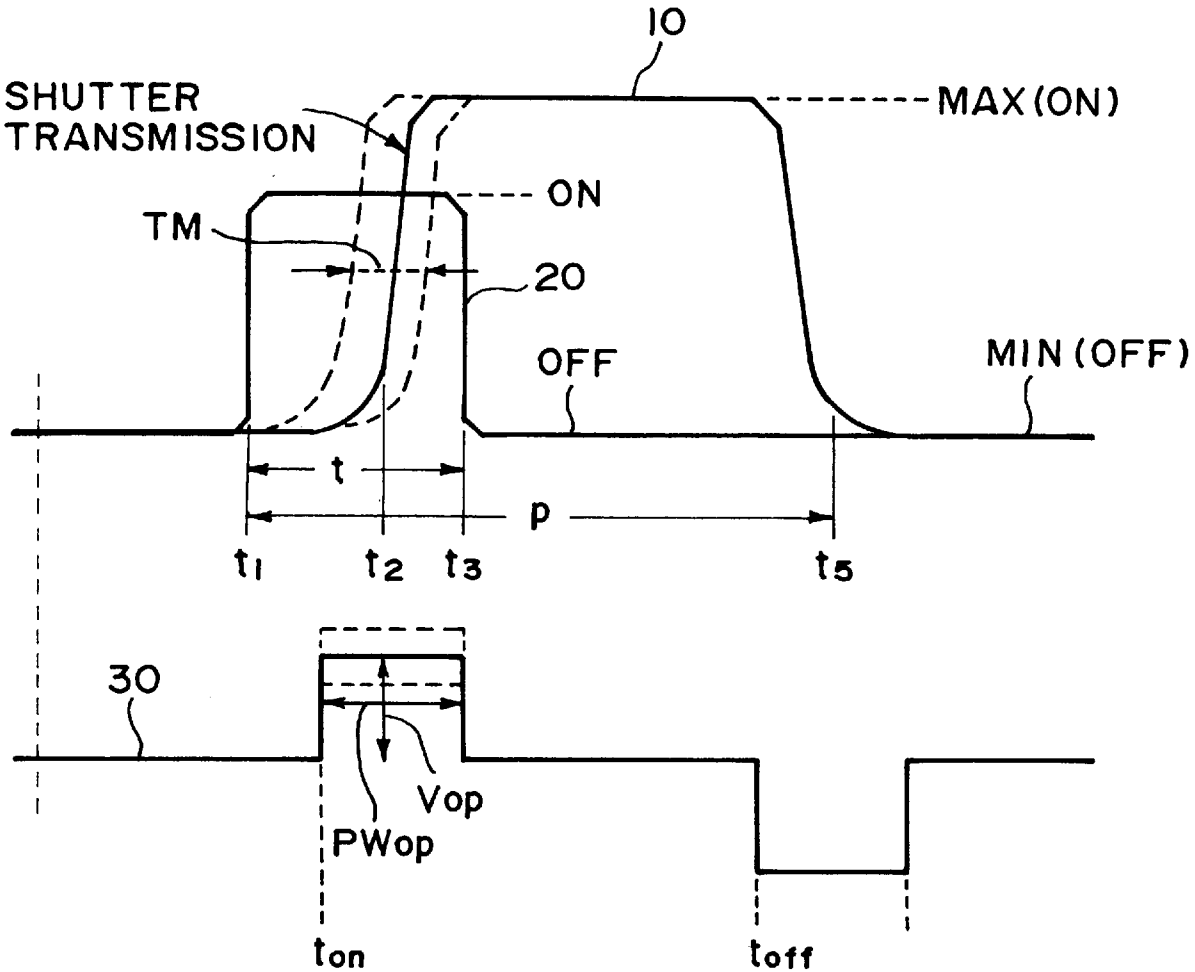
FIG. 3 is a time chart for illustrating a basic embodiment of the driving method for an optical modulation device according to the invention.

FIG. 3 is a time chart for illustrating a basic operation of the system shown in FIG. 1. Referring to FIG. 3, a curve 10 represents an optical transition of the optical shutter 1, a curve 20 represents the operation (lighting and non-lighting) of the light source 2; and a curve 30 represents a signal applied to the optical shutter, of which the amplitude (peak value) Vop (and further optionally pulse width PWop) is changed depending on given gradation data.

The light source is turned ON at time $t_1$ and turned OFF at time $t_3$, between which light is emitted from the light source for a period t, which is prescribed for providing a recognizable halftone. In parallel with a periodical operation (lighting) of the light source, the optical modulation substance is supplied with an applied voltage to switch from a dark state (Min) to a bright state Max when the time integration of the applied voltage exceeds a threshold.

A rise time $t_2$ of the switching depends on the amplitude Vop and pulse width PWop. As the amplitude Vop is modulated depending on gradation data, the time $t_2$ is changed within a time range TM depending on the gradation data. Time $t_{off}$ is a time for applying a signal for turning off the optical shutter, and the time integration of light quantity transmitted through the optical shutter 1 is governed by a time of overlapping between the lighting time (period) and a period in which the optical shutter is held in an ON state, so that the overlapping time (period) is changed (modulated) depending on the gradation data. As a result, the time integration of the transmitted light quantity may be easily modulated by changing the amplitude Vop in an analog manner at a constant pulse width PWop.

In any of the conventional digital duty modulation scheme, the application time $t_{on}$ of a voltage signal 30 is changed in a digital manner at constant pulse width PWop and amplitude PWop of the voltage signal 30.

In contrast, a novel feature of the present invention is that the signal 30 is treated as an analog quantity having varying amplitude (or/and pulse width) so as to allow an analog duty modulation.

Figure 4:
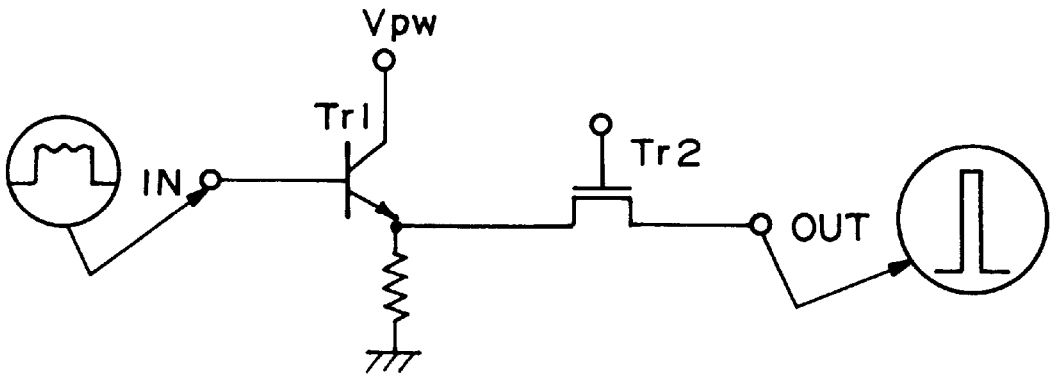
FIG. 4 is a diagram for illustrating an embodiment for generating gradation data used in the invention.

FIG. 4 shows an example of circuit generating an analog signal 30. Given gradation data is amplified by a transistor Tr1 and sampled by a switching transistor Tr2 to provide a signal having a modulated amplitude and a prescribed pulse width required for driving the optical shutter.

Then, another basic modulation scheme will be described with reference to FIG. 5, which shows another embodiment of the optical modulation apparatus or system according to the present invention.

Figure 5:
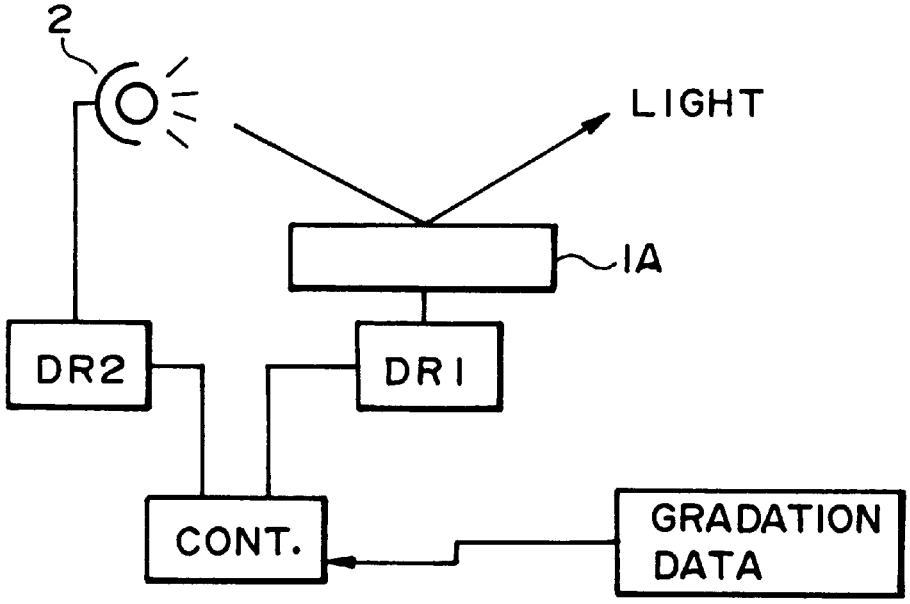
FIG. 5 is a block diagram showing another embodiment of the optical modulation system according to the invention.

The system shown in FIG. 5 is different from the one shown in FIG. 1 in that it includes a light reflection means 1A as an optical modulation means instead of the light transmission means 1 in FIG. 1. The light reflection means may comprise a liquid crystal device or a mirror device. Such a reflective-mode liquid crystal device may be constituted by forming one of a pair of substrates sandwiching a liquid crystal with a transparent member and the other with a reflective member so as to select a light-absorbing state or a light-reflecting state depending on an orientation state (optical state) of the liquid crystal. In the case of a mirror device, the reflection surface angle of the mirror may be controlled by moving the mirror to select a prescribed direction (ON state) suitable for reflection and another direction not causing reflection.

Then, the overlapping time between the lighting time of the light source 2 and the ON period of the reflection means 2 is modulated in an analog manner depending on given gradation data.

Herein, the ON period of the reflection means generally refers to a period in which the light source device is in a light-reflecting state or the mirror device has a reflecting surface directed in a prescribed direction. Alternatively, the ON period may be regarded as referring to a period where the reflection means assumes a non-reflecting state, e.g., a light-interrupting state. In this case, the resultant states are simply inverted.

(Drive Circuit)

Some description will be made regarding a drive circuit used in the present invention.

Figure 6:
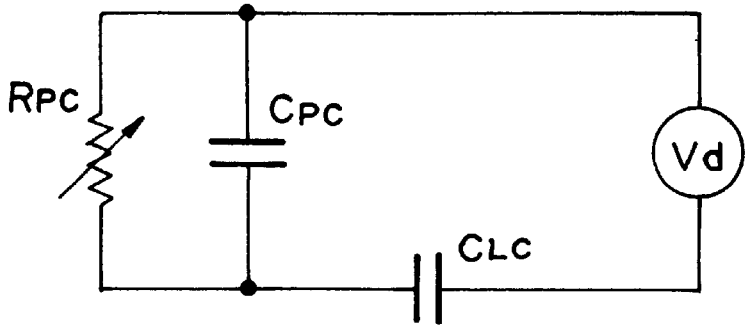
FIGS. 6, 7 and 8 are respectively a diagram of an embodiment of the drive circuit for an optical modulation device used in the invention.

FIG. 6 illustrates a drive circuit for an optical modulation means denoted by $C_{LC}$.

It is first assumed that a threshold of the optical modulation means $C_{LC}$ is applied while changing a resistance $R_{PC}$ corresponding to given gradation data. If the $R_{PC}$ is high, the time at which a voltage applied to $C_{LC}$ exceeds the threshold is delayed. On the other hand, if $R_{PC}$ is low, the time at which the voltage applied to $C_{LC}$ exceeds the threshold comes early. Accordingly, by adjusting the time of threshold exceeding and the point and period of lighting of the light source, the analog duty modulation of transmitted light or reflected light becomes possible.

Figure 7:
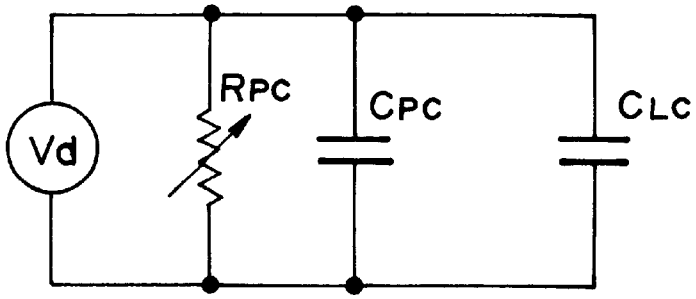

FIG. 7 shows another drive circuit which is different from the one shown in FIG. 6 only in that the optical modulation means $C_{LC}$ is connected in parallel with a resistance $R_{PC}$ and a capacitance $C_{PC}$. In this case, a sufficient voltage Vd is applied for a prescribed period to place the $C_{LC}$ in the ON state, and then a discharge phenomenon depending on the time constant of the RC circuit is utilized. At a higher $R_{PC}$ causing a slower discharge, the time at which the voltage applied to $C_{LC}$ subslides below the threshold is delayed. On the other hand, at a lower $R_{PC}$ causing a faster discharge, the time at which the voltage applied to $C_{LC}$ subsides below the threshold comes earlier. By setting the time within the lighting period of the light source, the light transmission or reflectance period can be modulated in an analog manner depending on a difference in the time.

Figure 8:
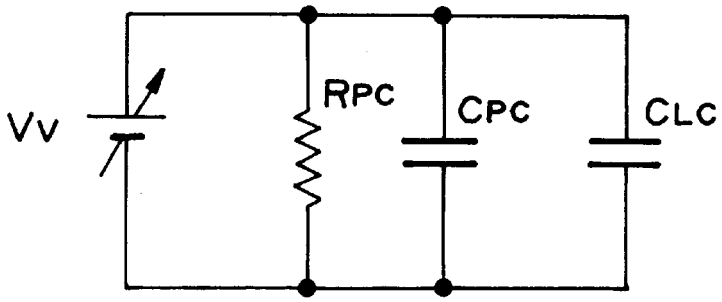

FIG. 8 shows another drive circuit example wherein gradation data is represented by a variable voltage $V_V$. Different from the one shown in FIG. 7, the time constant of an RC circuit including $R_{PC}$ and $C_{PC}$ is fixed, so that the time at which the voltage applied to $C_{LC}$ subsides below the threshold is determined by the voltage $V_V$ corresponding to gradation data. Accordingly, if the time is adjusted with the lighting period, an analog duty modulation becomes possible similarly as in the example of FIG. 7.

(Light Source)

Some description is made regarding a light source. Light emitted from the light source may be any of natural sunlight, white light, monochromatic light, such as red, green and blue lights, and combinations of these, and may be determined according to appropriate selection. Accordingly, examples of the light source suitably used in the present invention may include laser light sources, fluorescent lamps, xenon lamp, halogen lamp, light-emitting diode, and electroluminescence device. These light sources may be turned on and off in a controlled manner in synchronism with drive time of the optical modulation means. Particularly, a continuous lighting time of the light source may desirably be at most a reciprocal (e.g., 1/60 sec.) of a flickering frequency which provides a flicker noticeable by human eyes. In the case of color display, it is desired to energize the R, G and B light sources according to different time sequences so as to effect optical modulation of R, G and B according to time division. On the other hand, it is also possible to use a white light source in combination with color filters so as to use different colors of filters in time division to change the light (wavelength region) of the illuminating light.

(Optical Modulation Device)

The optical modulation device used in the present invention may include a light-transmission-type device called an optical shutter (or light valve) and a reflection device as a light reflection means for modulating light reflectance. A representative example thereof may include one called a spatial light modulation (SLM).

The optical shutter used in the present invention may be one capable of providing optically different two states. A preferred example thereof may be a liquid crystal device using a liquid crystal as an optical modulation substance.

A preferred type of liquid crystal device my be one comprising a liquid crystal disposed between a pair of electrodes so that liquid crystal molecules change their orientation states depending on an electric field applied thereto, and a light transmittance therethrough is controlled depending on the orientation state in combination with a polarizing device.

More specifically, it is possible to use a liquid crystal cell (or panel) comprising a pair of substrates between which a liquid crystal is sealed up. At least one of the mutually opposing inner surfaces of the substrates may be provided with a transparent electrode and an alignment film.

The substrates may comprise a transparent sheet of glass, plastic, quartz, etc. In case of constituting a device used as a reflection means, one substrate can be non-light-transmissive.

The transparent electrode may preferably comprise a metal oxide conductor, such as tin oxide, indium oxide or ITO (indium tin oxide).

The alignment film may preferably comprise a polymer film subjected to a uniaxial aligning treatment, such as rubbing, or an inorganic film formed by oblique vapor deposition.

The liquid crystal may suitably comprise a nematic liquid crystal operating in a nematic phase or a smectic liquid crystal operating in a smectic phase. It is further preferred to use a liquid crystal having a memory characteristic, such as a chiral smectic liquid crystal or a chiral nematic liquid crystal.

The reflection device used in the present invention may be a device called DMD (digital micromirror device) wherein a reflecting surface of a reflective metal is moved by an electrostatic force caused by an applied voltage so as to change the angle of the reflecting surface to modulate the emission direction of the reflected light, or a liquid crystal device of a reflection type including a liquid crystal cell (or panel) as described above, of which one surface is made reflective and the other surface is transmissive so that light incident thereto is reflected when the liquid crystal is placed in a light-transmissive state.

FIGS. 9A–9D show several transmittance-applied voltage characteristics of optical modulation elements (substances) usable in the present invention. In the case of the DMD, the ordinates may be regarded as representing a light quantity reflected in a prescribed direction.

Figure 9A:
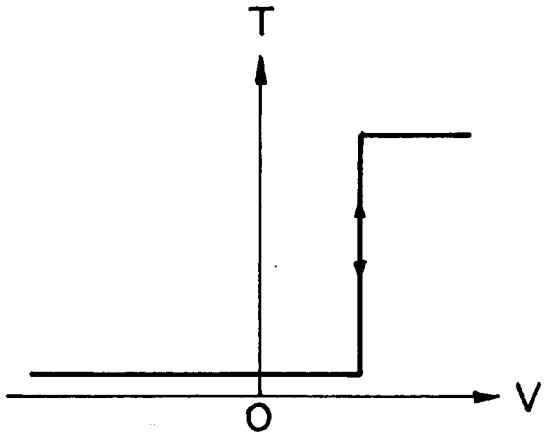
FIGS. 9A–9D are respectively a graph showing a transmittance-applied voltage characteristic of an optical modulation substance (or element) used in the invention.
Figure 9B:
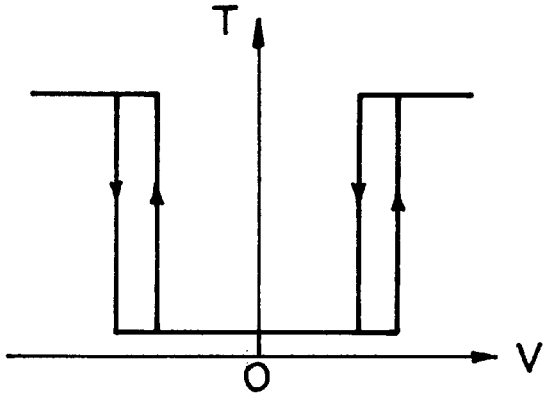

FIG. 9A shows a characteristic of an optical modulation substance causing a transition (switching) of optical states when a positive threshold voltage is exceeded. FIG. 9B shows a characteristic of an optical modulation substance having positive and negative thresholds each accompanied with a hysteresis. FIG. 5C shows a characteristic of an optical modulation substance showing a hysteresis providing positive and negative thresholds. FIG. 5D shows a characteristic exhibiting a threshold at a voltage of zero. FIGS. 9A–9D show characteristics in a somewhat simplified and ideal form, and a vertical line shown in these figures is actually inclined to provide a threshold value and a saturation value on both sides as shown in FIG. 2.

Figure 9C:
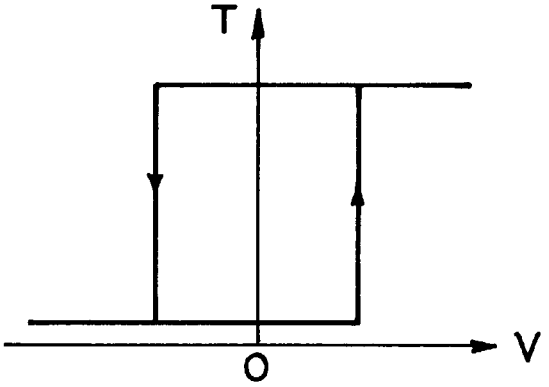
Figure 9D:
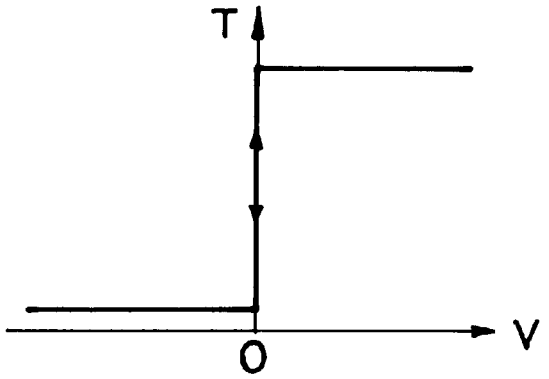

In respect of matching with drive circuits, the characteristic of FIG. 9A or 9B may preferably be combined with a parallel circuit shown in FIG. 7 or 8, and the characteristic of FIG. 9C or 9D may preferably be combined with a series circuit as shown in FIG. 6.

Now, a structure of a reflection device as a suitable example of spatial light modulator will be described with reference to FIG. 18.

Figure 18:
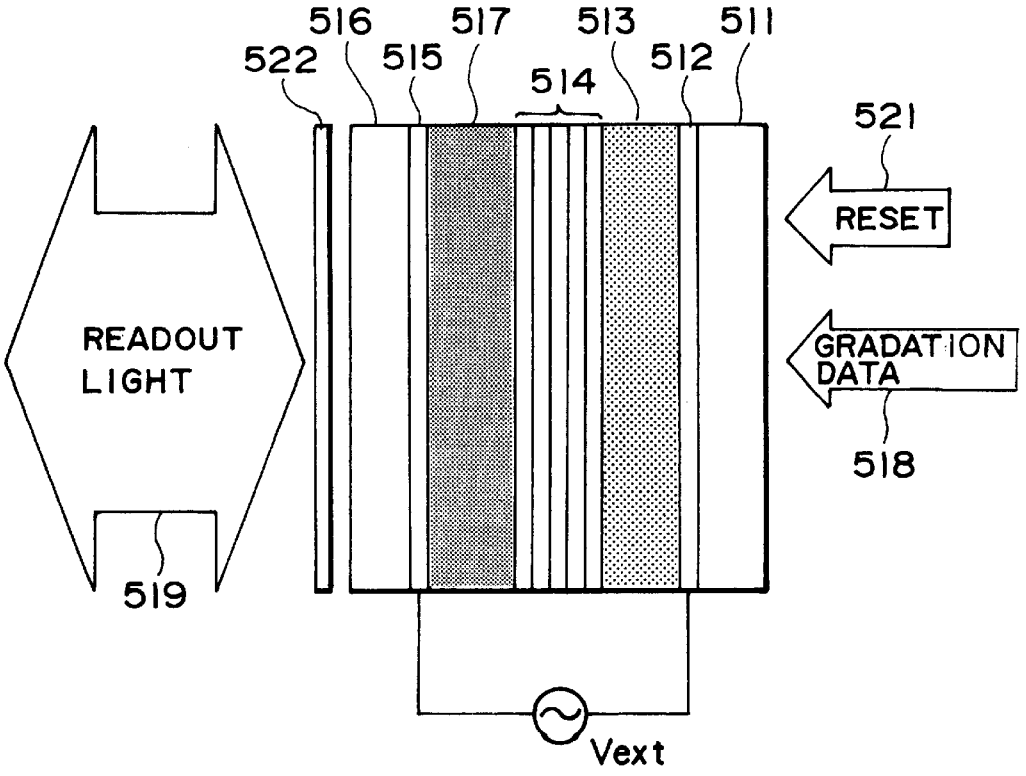
FIG. 18 is a schematic sectional view of an optical modulation device for an image display apparatus used in the invention.

Referring to FIG. 18, the device includes a pair of transparent substrates 511 and 516 having thereon transparent electrodes 512 and 515, respectively, a photoelectric conversion substance layer 513, a multi-layer dielectric laminate 514 and an optical modulation substance layer 517. The photoelectric conversion layer 513 may comprise a single layer or plural layers of photoconductor material or a photo-electromotive layer comprising a pn-junction or pin-junction.

The photoelectric conversion substance layer 513 may preferably comprise a non-single crystal semiconductor material, examples of which may include: amorphous silicon, amorphous silicon-germanium, amorphous silicon carbide, microcrystalline silicon, microcrystalline silicon-germanium, and microcrystalline silicon carbide. These semiconductor materials may optionally be doped with nitrogen, oxygen, boron, phosphorus, hydrogen, fluorine, chlorine, etc., so as to adjust the resistivity as desired.

The optical modulation substance layer 517 my preferably comprise a liquid crystal as described above. Preferred examples of chiral smectic liquid crystal may include ferroelectric liquid crystals having a memory characteristic, e.g., as disclosed in U.S. Pat. Nos. 5,120,466 and 5,189,536. Preferred examples of chiral nematic (cholesteric) liquid crystal may include those having a memory characteristic and assuming two stable states as disclosed in U.S. Pat. No. 4,239,345 and European Laid-Open Patent Appln. (EP-A) 0569029.

The multi-layer dielectric laminate 514 may preferably comprise a laminate of several to several tens layers of plural dielectric materials having mutually different refractive indices, such as titanium oxide and silicon oxide.

In the above-mentioned spatial light modulator, particularly one using an optical modulation substance having a memory characteristic, the optical modulation substance layer (i.e., a planar optical modulation element) may be provided with electric charges which may vary for respective local minute regions (domains) depending on inputted light data. As a result, the respective minute regions of optical modulation substance may be caused to have an optical state which may be switched at a time point depending on inputted photo-data. Consequently, the time integration of light quantity transmitted through or reflected at each minute region may be modulated depending on inputted light data. Accordingly, the above-mentioned spatial light modulation allows an analog halftone display for each minute region, thus allowing a mono-color or full-color display of an ultra-high resolution and a multiple gradation levels.

The present invention will be further described with specific embodiments.

(First Embodiment)

Figure 10:
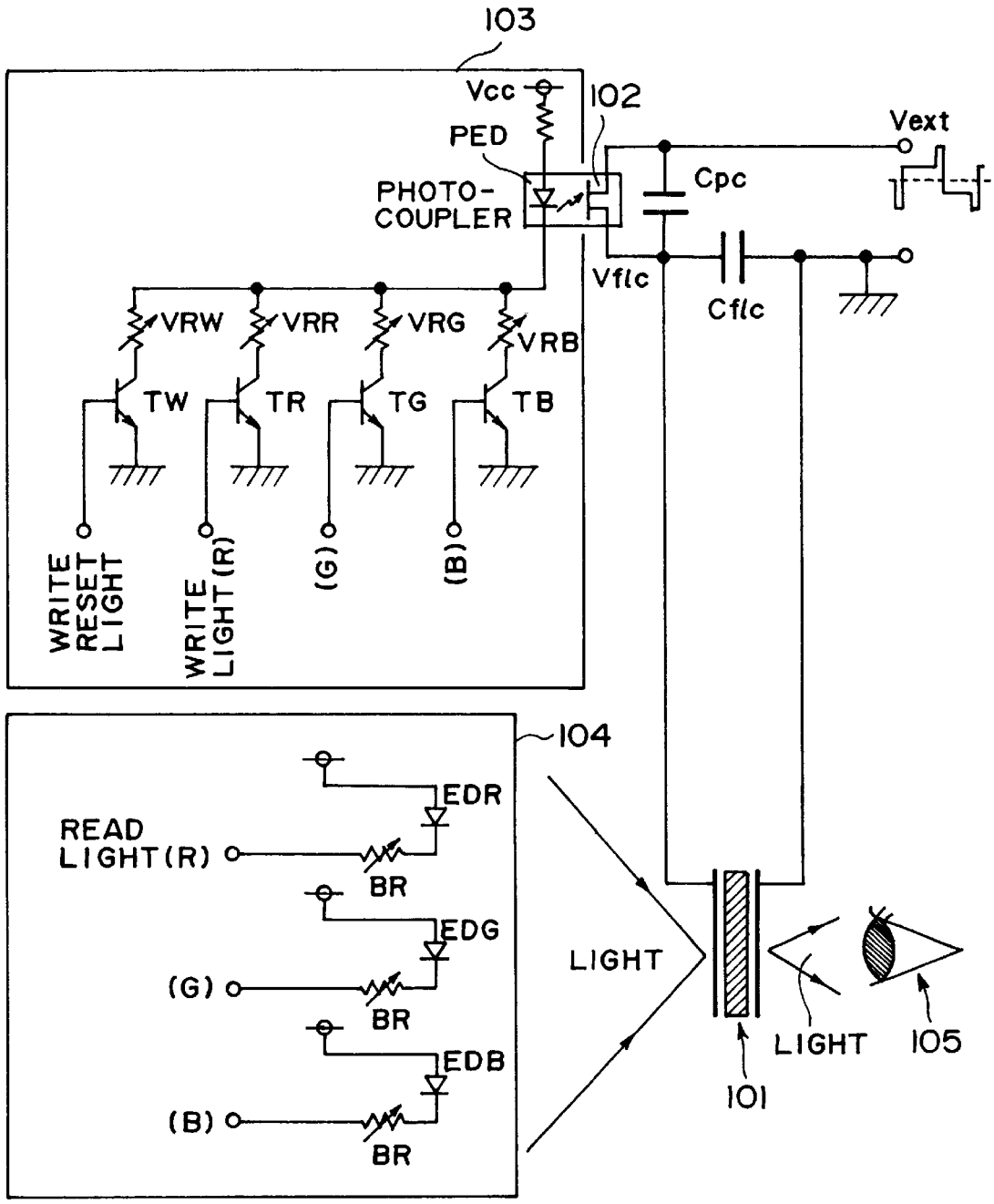
FIG. 10 is a circuit diagram of an optical modulation apparatus.

FIG. 10 illustrates an optical modulation system for driving an optical modulation device. The system includes a liquid crystal device 101 comprising a pair of substrate each having thereon an electrode and a ferroelectric chiral smectic liquid crystal disposed between the substrates, and a gradation data-generating circuit 103 for generating gradation data, a light source 105. In front of the system, an observer 105 is indicated. The system also includes a drive circuit including a capacitive element $C_{PC}$ and a transistor 102, of which the source-drain (or emitter-collector) resistance is changed by changing the gate or base potential of the transistor 102, thereby changing a time point at which the voltage exceeds the inversion threshold of the liquid crystal. The drive circuit includes a voltage application means $V_{ext}$ for applying a reset voltage and drive voltages to the liquid crystal device. $C_{flc}$ represents a capacitance of the liquid crystal.

The gradation data-generating circuit 103 includes a light-emitting diode PED, four variable resistances VRB, VRG, VRR and VRW, and four switching transistors TB, TG, TR and TW. The diode PED and the transistor 102 constitutes a photocoupler.

Electric signals in the form of variable resistance values constituting gradation data for respective colors are converted into light data by the light-emitting diode PED.

The light source 104 includes light-emitting diodes EDR, EDG and EDB for emitting light in three colors of R, G and B, and variable resistances BR optionally used for taking white balance.

Figure 11:
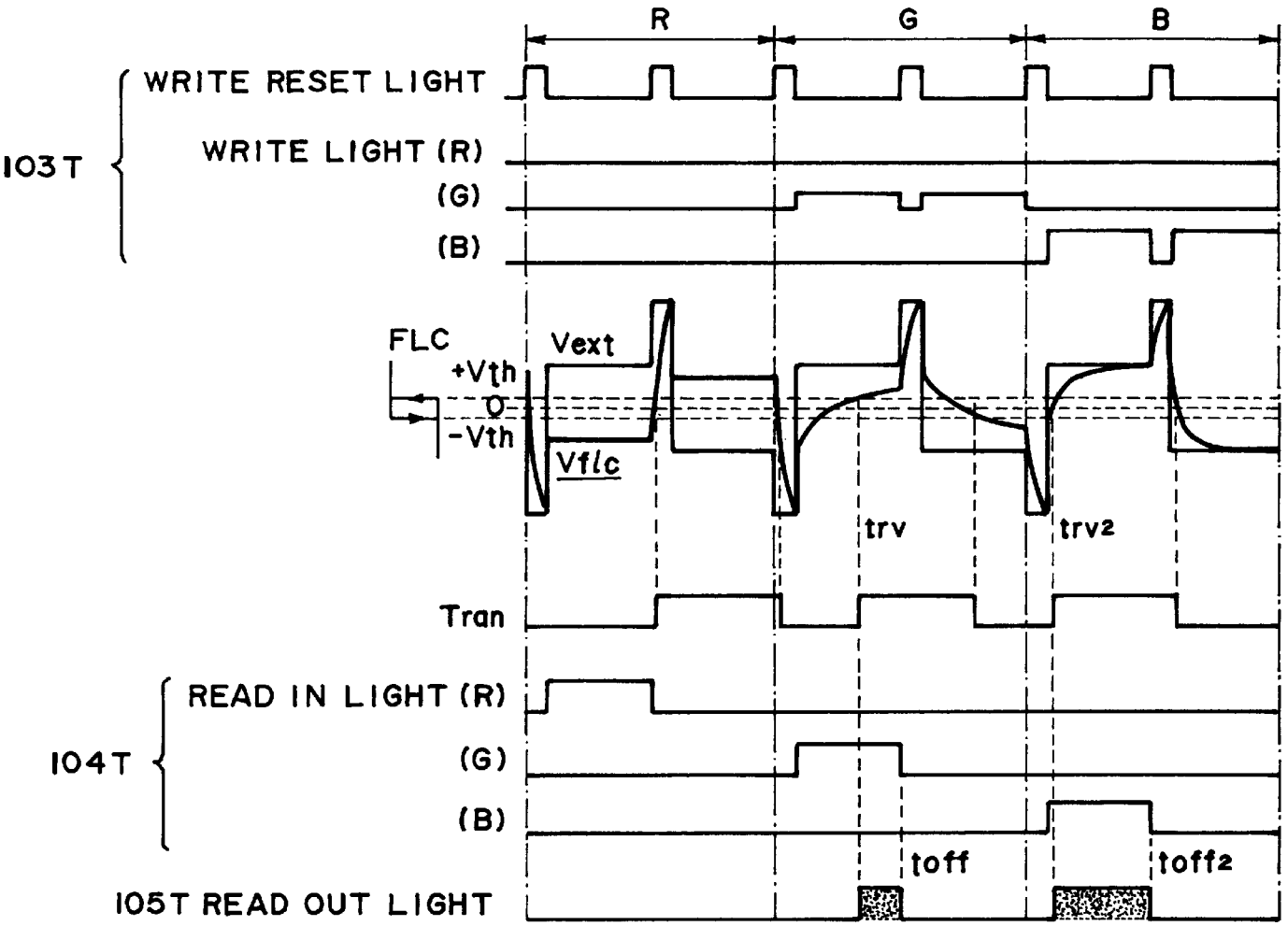
FIG. 11 is a time-serial waveform diagram for illustrating a manner of driving the optical modulation apparatus.

FIG. 11 is a time chart for operation of the system of FIG. 10. At 103T are shown time points for outputting light data. A curve $V_{flc}$ at FLC represents a voltage applied to the liquid crystal and a curve $V_{ext}$ represents a voltage applied from an external voltage supply $V_{ext}$. At $T_{ran}$ is shown a transmittance level through the liquid crystal device. At 104T are shown output levels of light sources. At 105T is a transmitted light quantity level recognized by the observer 105.

Referring to FIG. 11, first, white light for resetting is supplied, and a reset pulse is applied from the voltage application means $V_{ext}$, whereby the liquid crystal is once reset into a dark state.

Then, when light corresponding to R-gradation data is outputted, simultaneously, the R-light emitting diode EDR is turned on and $V_{ext}$ supplies a reverse-polarity voltage to the liquid crystal device. In this period, the R-light quantity from PED is very small, so that the effective voltage applied to the liquid crystal does not exceed the threshold Vth, and the liquid crystal device does not transmit the R-light from EDR.

Then, when white light is supplied again, $V_{ext}$ (a voltage supplied from the means $V_{ext}$) is increased to invert the liquid crystal into a light-transmission state. At this time, however, no light source 104 is energized, so that the observer continually recognizes the dark sate.

Then, $V_{ext}$ is changed into a negative voltage but the effective voltage applied to the liquid crystal does not exceed the threshold of −Vth, so that the liquid crystal device remains in the bright state. However, also in this period, no light source is energized.

R display period is terminated in the above-described manner (in the embodiment of FIG. 11).

Then, an operation in G-display period is performed similarly as in R-display period. G data light quantity is larger than in the case of R described above, so that the voltage applied to the liquid crystal exceeds the threshold Vth at time trv. Then, during a period until time $t_{off}$ when the G light source EDG is turned off, the liquid crystal device transmits the G-light, so that the observer recognizes a medium level of G-light.

Then, an operation in B-display period is performed similarly as in the R and G display periods. B data light quantity is further larger than in the case of G described above, so that the voltage applied to the liquid crystal exceeds the threshold Vth at time trv2. Then, during a period until time $t_{off}$ when the B light source EDB is turned off, the liquid crystal device transmits the B-light, so that the observer recognizes a medium level but close to a maximum level of B-light.

As described above, in this embodiment, the time (point and period) of $V_{flc}$ exceeding the threshold Vth is changed depending on gradation data. Further, the time of turning off a light source is determined so that the lighting period of the light source does not overlap with the transmission period (ON period) of the liquid crystal device corresponding to gradation data giving a minimum level of transmittance. More specifically, as a specific example, it may be appropriate to set each color display period at 30 μsec and set the continuous lighting time of each light source to be at most 15 μsec.

As a result, in this embodiment, it is possible to obtain a desired halftone level between a minimum level and a maximum level of brightness. Further, as the voltage applied to the liquid crystal is symmetrically balanced in positive and negative polarities, only a DC component of substantially zero is applied to the liquid crystal to suppress the deterioration of the liquid crystal device.

(Second Embodiment)

Figure 12:
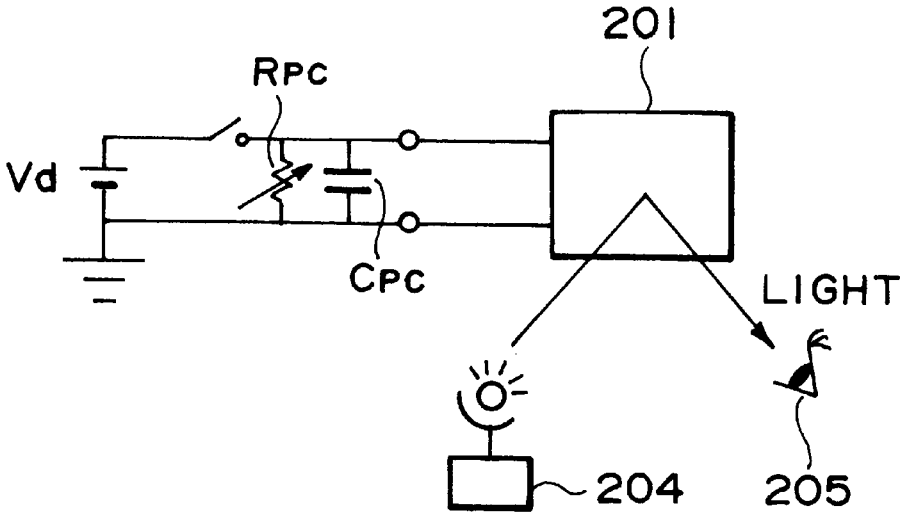
FIGS. 12, 14 and 16 are respectively a circuit diagram for an optical modulation apparatus.

FIG. 12 illustrates another embodiment of optical modulation system. The system includes a reflection-type liquid crystal device 201 comprising a pair of substrates each having thereon an electrode and a liquid crystal disposed between the substrates, a light source-drive circuit 204 for driving a light source, a capacitive element $C_{PC}$, a resistive element $R_{PC}$, and a drive voltage supply Vd. In this system, a circuit is constituted so that the resistive element $R_{PC}$ is caused to have a resistance value varying depending on inputted gradation data.

The liquid crystal used may have a transmittance-applied voltage (T-V) characteristic as shown in FIG. 9A.

Figure 13:
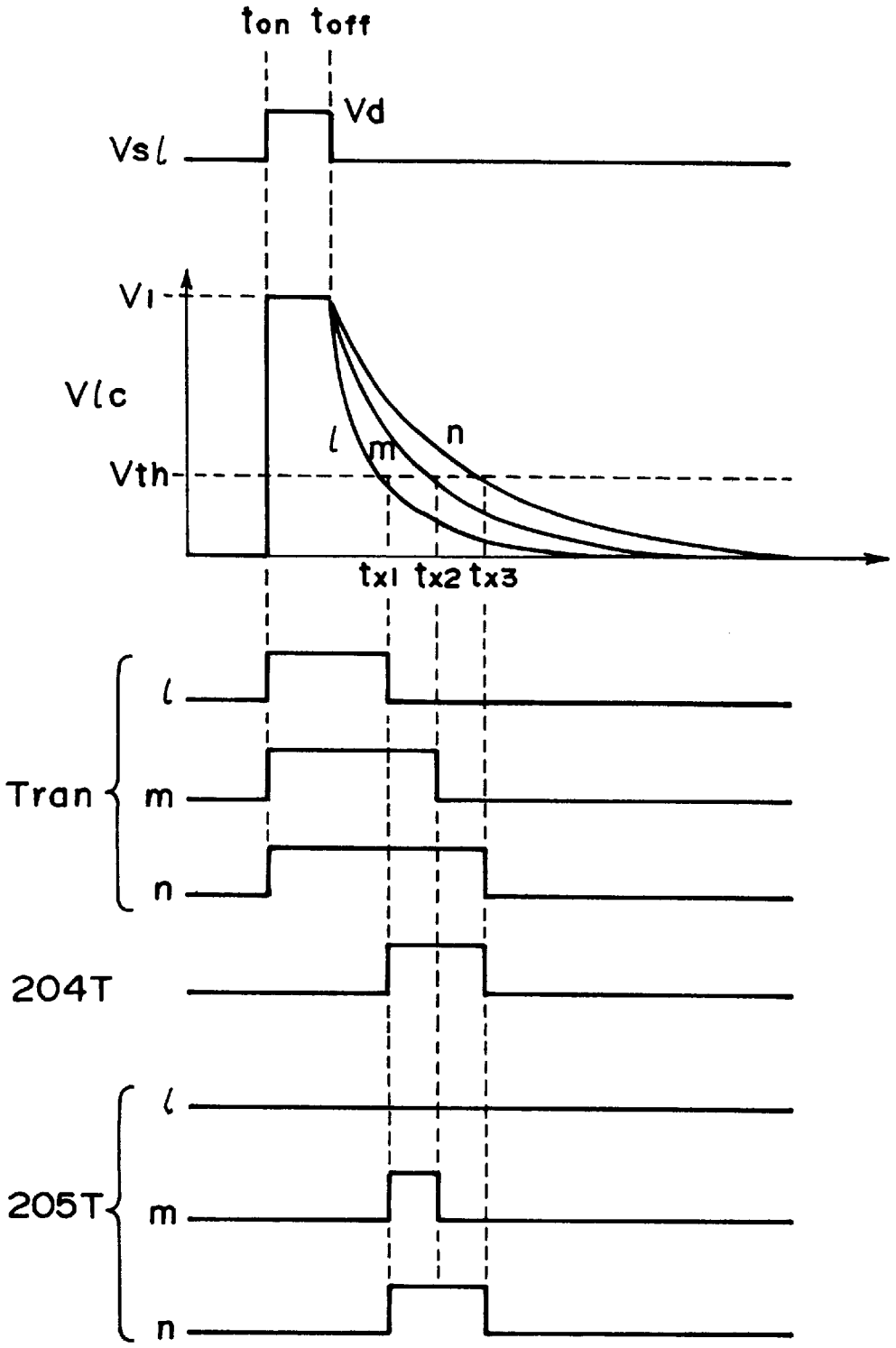
FIGS. 13, 15 and 17 are diagrams showing time-serial waveforms used for driving the optical modulation apparatus of FIGS. 12, 14 and 16, respectively.

FIG. 13 is a time chart for driving the system of FIG. 12. $V_{SI}$ represents an application time of voltage Vd, $V_{lc}$ represents a voltage applied to the liquid crystal, $T_{ran}$ represents a reflectance of the liquid crystal device, 204T represents a lighting time of the light source, and 205T represents reflected light quantities recognized by the observer including a curve l given by a low value of $R_{PC}$, a curve m given by a medium value of $R_{PC}$ and a curve n given by a high value of $R_{PC}$, respectively corresponding to levels of analog gradation data.

Referring to FIG. 13, at time $t_{on}$, Vd is applied to the liquid crystal device and the voltage $V_{lc}$ applied to the liquid crystal assumes Vl sufficiently exceeding a threshold Vth, so that the liquid crystal device exhibits a maximum reflectance.

At time $t_{off}$, the voltage Vd is removed, whereby the voltage $V_{lc}$ applied to the liquid crystal is gradually lowered depending on the value of resistance $R_{PC}$ to subside below the threshold Vth at some time which depends on the gradation data, i.e., time $t_{x1}$ for l, $t_{x2}$ for m and $t_{x3}$ for n, when the transmittance Tran respectively assumes the lowest level respectively. In this embodiment, the light source is designed to be turned on at time $t_{x1}$ and turned off at time $t_{x3}$ as shown at 204T, so that the reflected light quantity 205T assumes the levels as represented by curves l, m and n for the cases of l, m and n, respectively, of $V_{lc}$. By setting the lighting time in this manner, an excellent linearity of halftone display is given.

As described above, in this embodiment, the time of $V_{lc}$ subsiding below the threshold is changed depending on gradation data. Further, the time of turning on a light source is determined so that the lighting period of the light source does not overlap with the reflection period (ON period) of the liquid crystal device corresponding to the gradation data giving a minimum level of reflectance.

As a result, in this embodiment, it is possible to obtain a desired medium reflection state between the minimum brightness level l and the maximum brightness level n.

(Third Embodiment)

Figure 14:
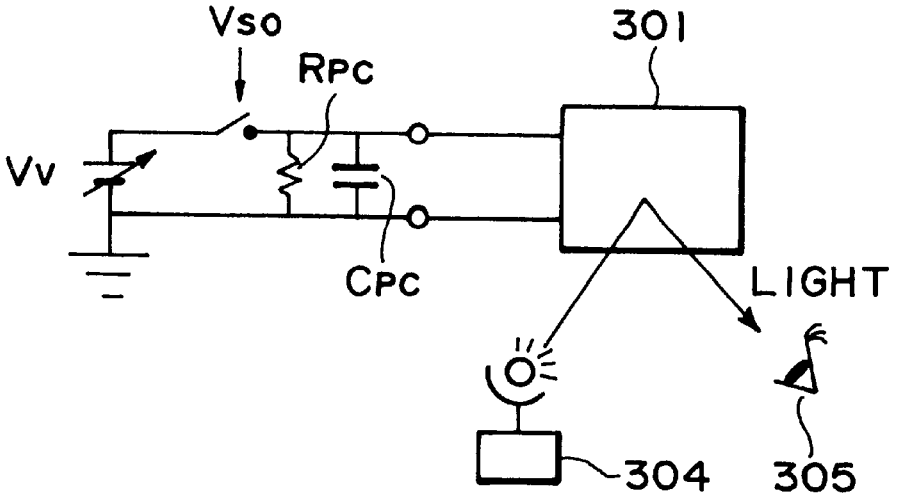

FIG. 14 illustrates another embodiment of optical modulation system. The system includes a reflection-type liquid crystal device 301 comprising a pair of substrates each having thereon an electrode and a liquid crystal disposed between the substrates, a light source-drive circuit 304 for driving a light source, a capacitive element $C_{PC}$, a resistive element $R_{PC}$, a drive voltage supply Vv and a switch $V_{S0}$ for turning on and off the supply of a voltage signal from the drive voltage supply Vv. In this system, the voltage signal supplied from the drive voltage supply Vv carries analog gradation data.

The liquid crystal used may have a transmittance-applied voltage (T-V) characteristic as shown in FIG. 9A.

Figure 15:
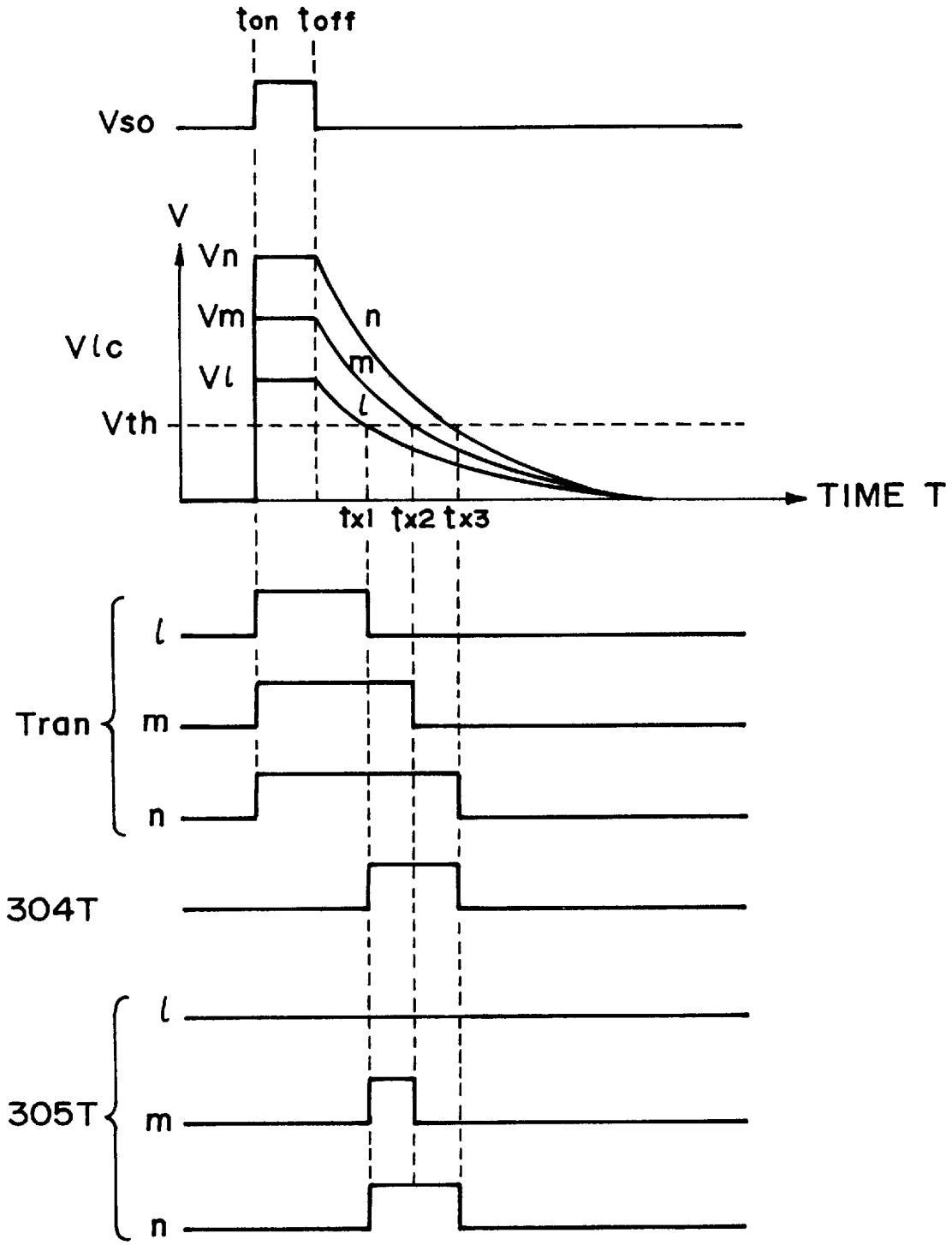

FIG. 15 is a time chart for driving the system of FIG. 14. $V_{S0}$ represents an application time of gradation signal, $V_{lc}$ represents a voltage applied to the liquid crystal, $T_{ran}$ represents a reflectance of the liquid crystal device, 304T represents a lighting time of the light source, and 305T represents reflected light quantities recognized by the observer including a curve l given by a low voltage Vl, a curve m given by a medium voltage Vm and a curve n given by a high voltage Vn, respectively corresponding to levels of the gradation signals.

Referring to FIG. 15, at time $t_{on}$, Vv is applied to the liquid crystal device and the voltage $V_{lc}$ applied to the liquid crystal assumes voltages Vl, Vm and Vn each sufficiently exceeding a threshold Vth, so that the liquid crystal device exhibits a maximum reflectance in any case.

At time $t_{off}$, the voltage Vv is removed, whereby the voltage $V_{lc}$ applied to the liquid crystal is gradually lowered corresponding to the voltage Vv to subside below the threshold Vth at some time which depends on the gradation data, i.e., time $t_{x1}$ for l, $t_{x2}$ for m and $t_{x3}$ for n, when the transmittance Tran assumes the lowest level respectively. In this embodiment, the light source is designed to be turned on at time $t_{x1}$ and turned off at time $t_{x3}$ as shown at 304T, so that the reflected light quantity 305T assumes the levels as represented by curves l, m and n for the cases of l, m and n, respectively, of $V_{lc}$.

As described above, in this embodiment, the time of $V_{lc}$ subsiding below the threshold is changed depending on gradation data. Further, the time of turning on a light source is determined as that the lighting period of the light source does not overlap with the reflection period (ON period) of the liquid crystal device corresponding to the gradation data giving a minimum level of reflectance.

As a result, in this embodiment, it is possible to obtain a desired medium reflection state between the minimum brightness level l and the maximum brightness level n.

(Fourth Embodiment)

Figure 16:
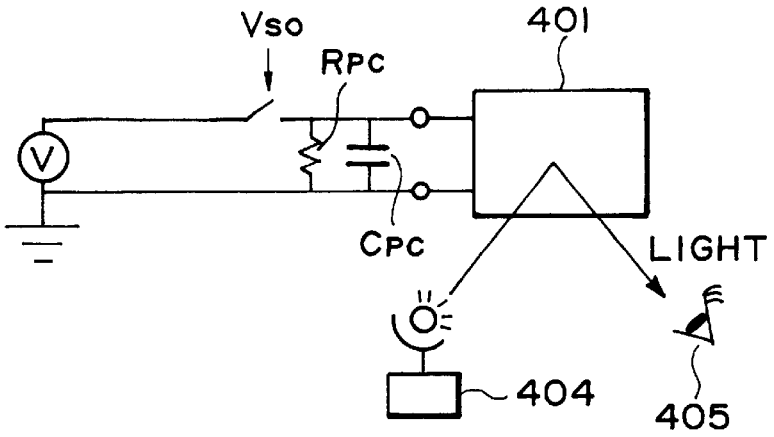

FIG. 16 illustrates another embodiment of optical modulation system. The system includes a reflection-type liquid crystal device 401 comprising a pair of substrates each having thereon an electrode and an anti-ferroelectric chiral smectic liquid crystal disposed between the substrates, a light source-drive circuit 404 for driving a light source, a capacitive element $C_{PC}$, a resistive element $R_{PC}$, a drive voltage supply Vv, and a switch $V_{SO}$ for turning on and off the supply of a voltage signal from the drive voltage supply Vv. In this system, the voltage signal supplied from the drive voltage supply Vv carries analog gradation data. In front of the liquid crystal device 401, an observer 405 is indicated.

The chiral smectic liquid crystal used may have a transmittance-applied voltage (T-V) characteristic as shown in FIG. 9B.

Figure 17:
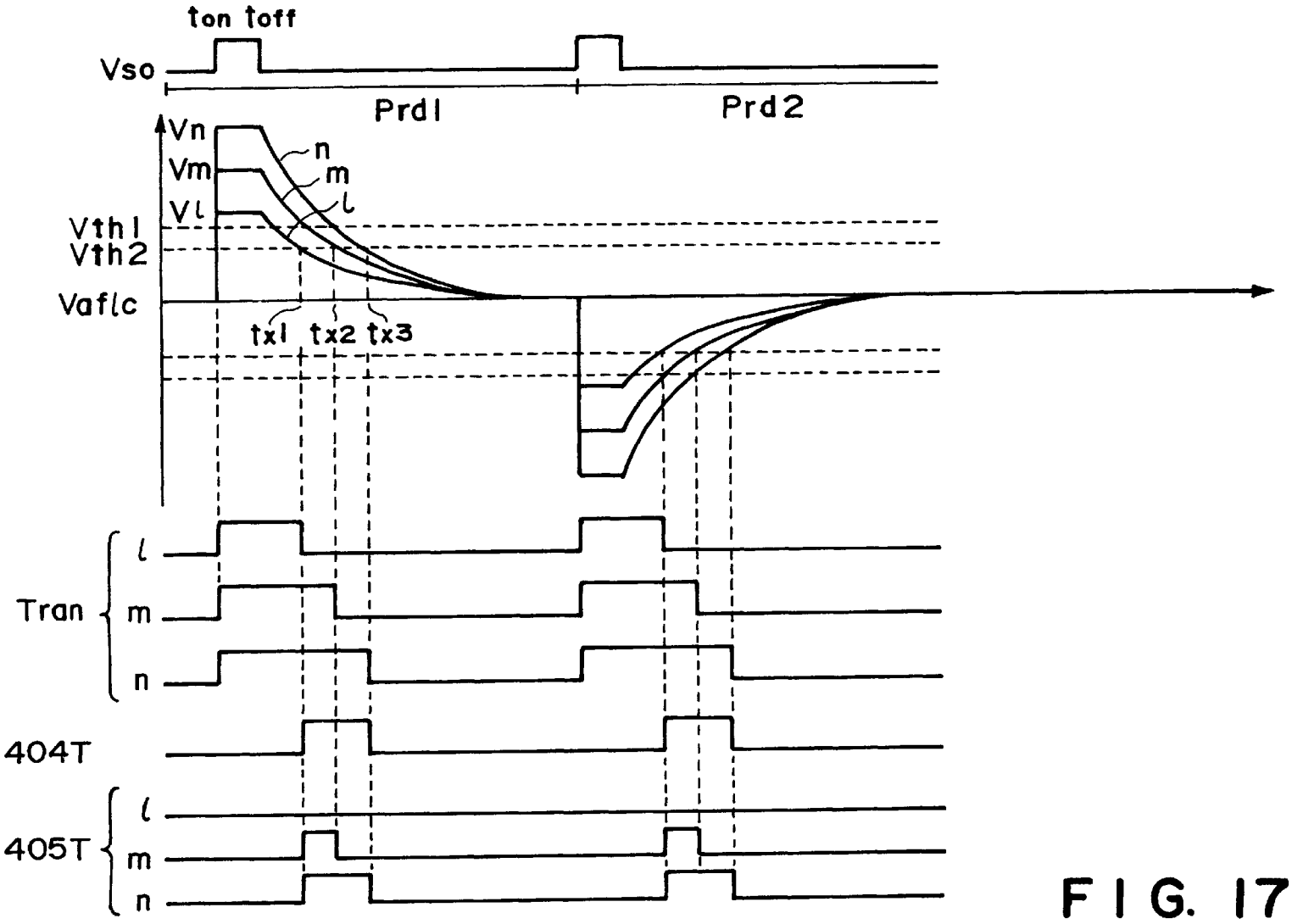

FIG. 17 is a time chart for driving the system of FIG. 16. $V_{SO}$ represents an application time of gradation signal, $V_{aflc}$ represents a voltage applied to the liquid crystal, $T_{ran}$ represents a reflectance of the liquid crystal device, 404T represents a lighting time of the light source, and 405T represents reflected light quantities recognized by the observer including a curve l given by a low voltage of Vl, a curve m given by a medium voltage Vm and a curve n given by a high voltage Vn, respectively corresponding to levels of the gradation signals.

Referring to FIG. 17, at time $t_{on}$, Vd is applied to the liquid crystal device and the voltage $V_{aflc}$ applied to the liquid crystal assumes Vl, Vm or Vn each sufficiently exceeding a threshold Vth, so that the liquid crystal device exhibits a maximum reflectance in case case.

At time $t_{off}$, the voltage Vv is removed, whereby the voltage $V_{aflc}$ applied to the liquid crystal is gradually lowered corresponding to the voltage Vv to subside below the threshold Vth at some time which depends on the gradation data, i.e., time $t_{x1}$ for l, $t_{x2}$ for m and $t_{x3}$ for n, when the transmittance Tran assumes the lowest level respectively. In this embodiment, the light source is designed to be turned on at time $t_{x1}$ and turned off at time $t_{x3}$ as shown at 404T, so that the reflected light quantity 405T assumes the levels as represented by curves l, m and n for the cases of l, m and n, respectively, of $V_{aflc}$.

It is further preferred to set one cycle period (each of Prd1 and Prd2 in FIG. 17) to be at most 1/30 sec and the continuous lighting time of a light source to be at most 1/60 sec or shorter.

This embodiment is different from the embodiment of FIGS. 14 and 15 in that an anti-ferroelectric liquid crystal is used and, corresponding thereto, in a period Prd2, the voltage Vv is inverted from the one used in the preceding period Prd1. The anti-ferroelectric liquid crystal can provide two thresholds due to a hysteresis in opposite polarities but, even if the polarity of the voltage Vv is inverted, the optical state of the liquid crystal is identical as shown at Tran. A chiral smectic liquid crystal shows a fast speed of transition between two molecular orientation states (switching speed) and may be a liquid crystal optimally used in the present invention inclusive of the present embodiment.

As described above, in this embodiment, the time of $V_{aflc}$ subsiding below the threshold is changed depending on gradation data. Further, the time of turning on a light source is determined so that the lighting period of the light source does not overlap with the reflection period (ON period) of the liquid crystal device corresponding to the gradation data giving a minimum level of reflectance.

In the present invention, it is possible to use a two-dimensionally extending device in which a large number of optical modulation elements each functionally equivalent to an light-transmission device (optical shutter) or a high-reflection device as described in the above-mentioned embodiment are arranged in a two-dimensional matrix. Instead of such a two-dimensional matrix device, it is also possible to use a planar optical modulation device having a two-dimensional extension, each local region (domain) of which functions equivalently as an optical modulation device or element as described above.

More specifically, it is possible to use a panel having a two-dimensional extension along which a multiplicity of transmission-type or light emission-type pixels are arranged and a DMD including a multiplicity of micromirrors arranged in a matrix. As an example of planar optical modulation device, it is possible to use an optical-writing-type device including a large-area electrode not patterned to form discrete pixels but allowing a two-dimensional image-processing by a local address.

Next, an image display system, as an embodiment of the optical modulation system, according to the present invention, will be described.

(Fifth Embodiment)

FIG. 18 is a sectional view of an optical modulation device used in an image display apparatus according to this embodiment.

Figure 19A:
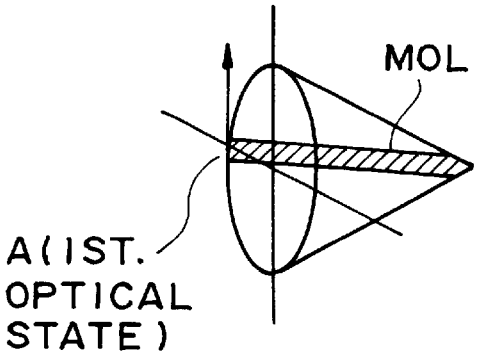
FIGS. 19A and 19B are schematic illustrations of two molecular orientations (optical states) of a chiral smectic liquid crystal used in the device of FIG. 18.
Figure 19B:
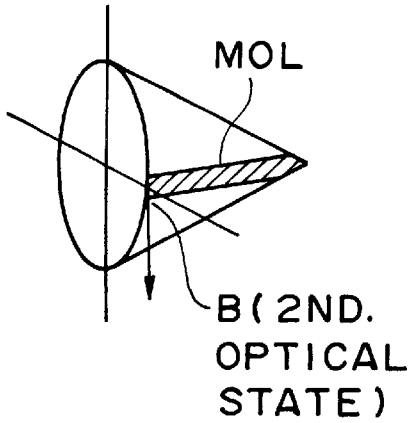
Figure 20:
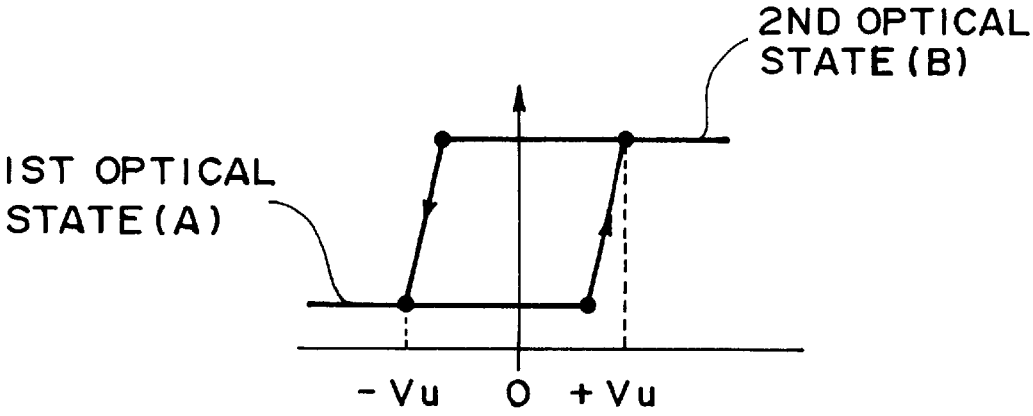
FIG. 20 is a graph showing an electrooptical characteristic of the liquid crystal used in the device of FIG. 18.
Figure 21:
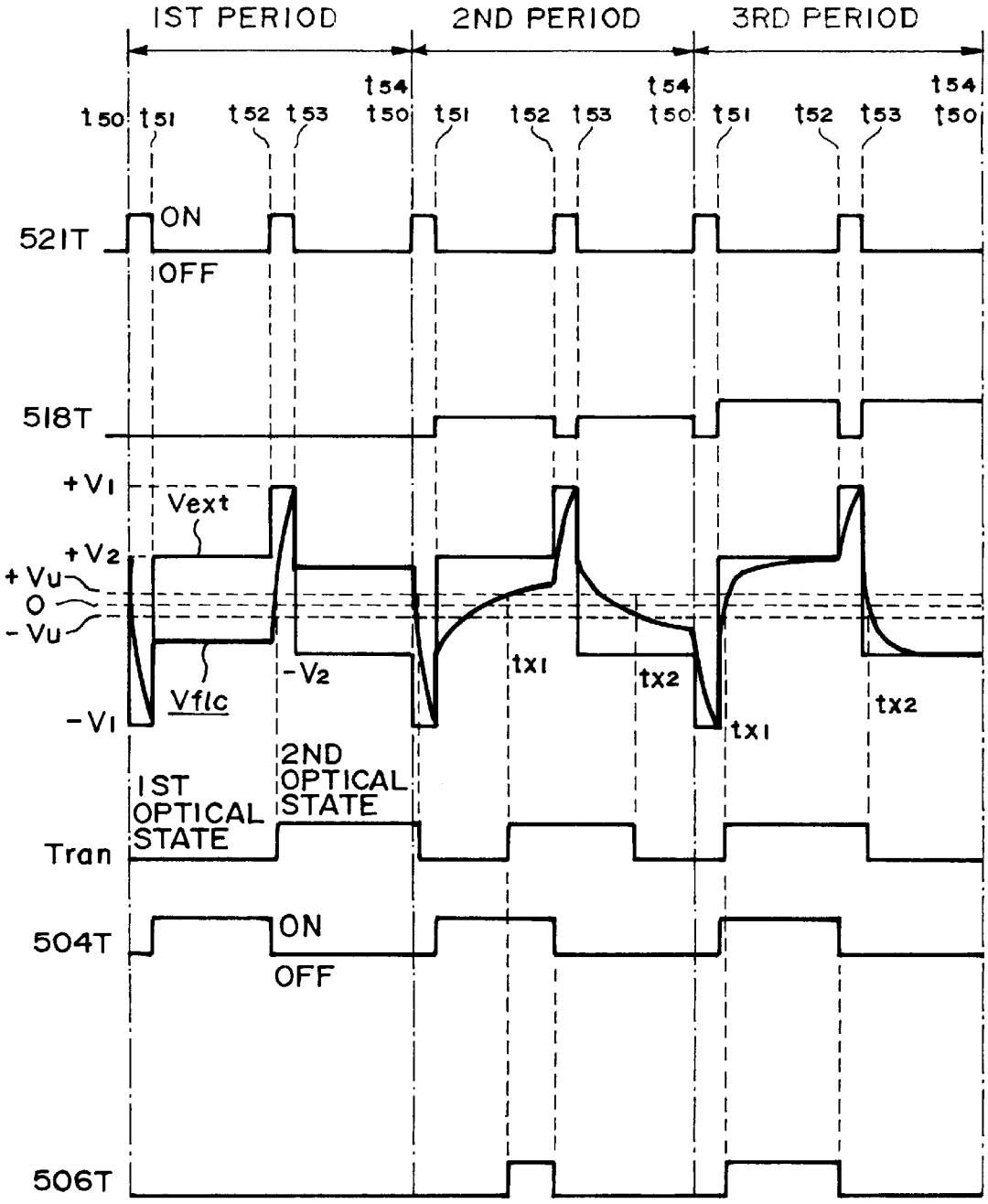
FIG. 21 is a time chart for illustrating an operation of the device of FIG. 18.

FIGS. 19A and 19B schematically show two molecular orientation states (optical states) of a chiral smectic liquid crystal used in the device. FIG. 20 is a graph showing an electrooptical characteristic of the device including the two optical states. FIG. 21 is a time chart for illustrating the operation of the device.

The device shown in FIG. 18 constitutes a so-called reflection-type liquid crystal panel. In the device, a transparent substrate 511 is successively provided thereon with a transparent electrode 512, a photoconductor layer 513 as a photosensitive layer, and a dielectric multi-layer film 514 as a reflection layer. The other transparent substrate 516 is provided with a transparent electrode 515. Between the two substrates, a chiral smectic liquid crystal (sometimes abbreviated as "FLC") 517 as an optical modulation substance is disposed. A polarizer 522 is further disposed on the light incidence side. While not shown in the figure, alignment films for aligning liquid crystal molecules are disposed at boundaries of the liquid crystal layer 517 with the electrode 515 and the reflection layer 514. An external voltage application means $V_{ext}$ is connected to the electrodes 512 and 515 so as to apply a voltage between the electrodes. The device thus constituted is illuminated with reset light 521, writing light 518 carrying gradation data and readout light 519 for reading out the modulated gradation data, i.e., the image.

The device may be represented by an equivalent circuit shown in FIG. 6.

FIG. 19A shows a first orientation state (optical state) of a liquid crystal molecule ML, and FIG. 19B shows a second orientation state (optical state) of the molecule ML. When the liquid crystal in the first orientation state (FIG. 19A) is supplied with a voltage +Vu, the liquid crystal is switched to the second orientation state (optical state) (FIG. 19B). The resultant second orientation state (FIG. 19B) is retained even if the voltage is zero, i.e., placed under no electric field. Then, if a reverse polarity voltage −Vu is applied to the liquid crystal, the liquid crystal is switched to the first orientation state (FIG. 19A) which is retained even after removal of the electric field. The switching may also be called a transition or inversion of the liquid crystal. The first and second orientation states shown in FIGS. 19A and 19B are both stable, and the liquid crystal therefore has a memory characteristic.

The states shown in FIGS. 19A and 19B are optically different states (different optical states) so that one may be placed in a maximum transmittance state and the other in a minimum transmittance state by appropriately combining a polarizer. Herein, the voltage value Vu is used for denoting voltage exceeding a saturation voltage which is assumed to be substantially identical to the inversion threshold voltage.

Now, the operation of the device will be described. For easier comprehension of the operation principle, it is assumed that the capacitance $C_{flc}$ of the liquid crystal layer 517 and the capacitance $C_{PC}$ of the photoconductive layer 513 are identical to each other, the liquid crystal layer 517 has an infinitely large resistance, and the reflection layer 514 has an impedance of zero. Referring to FIG. 21, 521T and 518T respectively represent the illumination time of reset light 521 illuminating the photoconductor layer 513 and the illumination time of the writing light 518 illuminating the photoconductor layer 513 and having an intensity varying depending the gradation data. $V_{ext}$ represents an alternating voltage applied to the transparent electrodes 512 and 515 on both sides of the device, and $V_{flc}$ represents an effective voltage applied by voltage division on both sides of the liquid crystal layer 517. +Vu and −Vu represent voltages for causing the inversion from the first to second state and from the second to first state, respectively, of the liquid crystal as shown in FIG. 20. Tran represents orientation states (first and second) of FLC. In this embodiment, it is assumed that the polarizing device 522 functioning as both a polarizer and an analyzer is positionally adjusted so that the first orientation state (optical state) provides a dark state of the lowest transmittance and the second orientation state (optical state) provides a bright state of the highest transmittance. 504T represent the lighting time of readout light 519 illuminating the liquid crystal layer 517, and 505T represents a level of output light formed by passing the readout light through the polarizer 522 the liquid crystal 517, the reflection layer 517 and the analyzer 522.

Referring to FIG. 21, in a reset period of from time $t_{50}$ to $t_{51}$, $V_{ext}$ (a voltage level supplied from a voltage supply $V_{ext}$) assumes a voltage $-V_1$ and the photoconductor layer 513 is illuminated with reset light, whereby photocarriers (electron-hole pairs) are generated in the photoconductor layer 513 and the electrons and holes move in opposite directions under an electric field applied by voltage division to the photoconductor layer to be on both sides of the liquid crystal layer 517. As a result of this operation, $V_{flc}$ approaches the potential $-V_1$. As an explanation based on the equivalent circuit of FIG. 6, the voltage change may also be understood as a result of the phenomena that the resistance component in the photoconductor layer is lowered by a photoconductive effect to cause a self-discharge and a potential provided to the photoconductor layer by voltage division is lowered, whereby $V_{flc}$ approaches $-V_1$. When the reset light has a sufficient light intensity, $V_{flc}$ can be reset to $-V_1$ by the time $t_{51}$ regardless of the previous state, so that the first optical state (dark) of the liquid crystal is ensured. At time $t_{51}$, the reset light is turned off, $V_{ext}$ is changed to $+V_2$. At this time, potential $V_{flc}$ is changed by 1:1-capacitance division to $V_3=-V_1+(V_2-(-V_1))/2$. If no writing light is supplied as in the first period of this embodiment, $V_{flc}$ remains at $V_3$ until $t_{52}$, and the liquid crystal remains in the first optical state (dark) as $V_3<Vu$. Then, in a period after $t_{52}$, an operation similar to the one in the period of $t_{50}$–$t_{52}$ is performed while changing the polarity of $V_{ext}$. As a result, the integration of $V_{flc}$ in one (cycle) period provides a DC component of 0, so that an AC symmetry of drive waveform required for stable FLC drive is ensured. In a period of $t_{52}$ to $t_{53}$, $V_{flc}$ exceeds Vu to be reset at V1 so that the liquid crystal is inverted into the second optical state (bright).

In a second (cycle) period, the device is illuminated with writing light. The writing light has an intensity smaller than the reset light so that $V_{flc}$ approaches $V_{ext}$ at a slower time constant. In case where the writing light has a certain large strength or larger, $V_{flc}$ exceeds Vu at time $t_{x1}$ in a period T (of $t_{51}$ to $t_{52}$), when the liquid crystal is inverted from the first optical state to the second optical state. In case where the writing light is further intense as in a third period, the $T_{x1}$ becomes closer to $t_{51}$ so that the liquid crystal is inverted into the second optical state at an earlier time. In each of the second and third cycle periods, writing light similar to that used in the period of $t_{51}$ to $t_{52}$ is supplied in the period of $t_{53}$ to $t_{54}$ (i.e., $t_{50}$ in a subsequent cycle period), $V_{flc}$ subsides −Vu at time $t_{x2}$ whereby the liquid crystal is returned to the first optical state (dark). In any of the first–third periods, the AC symmetry of $V_{flc}$ is ensured and, in each period, the liquid crystal assumes the first optical state and the second optical state for 50% each of the period. As the writing light intensity increases, the second optical state of FLC is phase-shifted to be earlier.

In parallel with the above liquid crystal state change, readout light is supplied in a period of $t_{51}$ to $t_{52}$ in each cycle period, the observers recognize output light only for an overlapping period between a lighting period of the readout light and the second optical state (bright) period of FLC. As a result, no output light is given in the first cycle period but output light flux is increased as the writing light intensity is increased to provide longer overlapping periods as in the second and third cycle periods. The change in output light flux is recognized by the observer as a change in light intensity if each cycle period is set to be shorter than a period (e.g. 1/60 sec) of a minimum frequency giving a flicker noticeable to human eyes (i.e., a flickering frequency, e.g., 60 Hz).

On the other hand, if readout light is supplied in the period of $t_{53}$–$t_{54}$ instead of the period of $t_{51}$–$t_{52}$, the overlapping period is reduced to reduce output light reflux as the writing light intensity is increased. Accordingly it is possible to effect a negative-positive exchange between the writing light and the readout light. Writing light may have a two-dimensionally planar spreading so that it is possible to form a planar potential distribution depending on the writing light intensity, thereby providing a so-called photo-writing-type spatial light modulation allowing a two-dimensional photo-writing and readout. As a result, it is possible to form a monochromatic film viewer.

Figure 22:
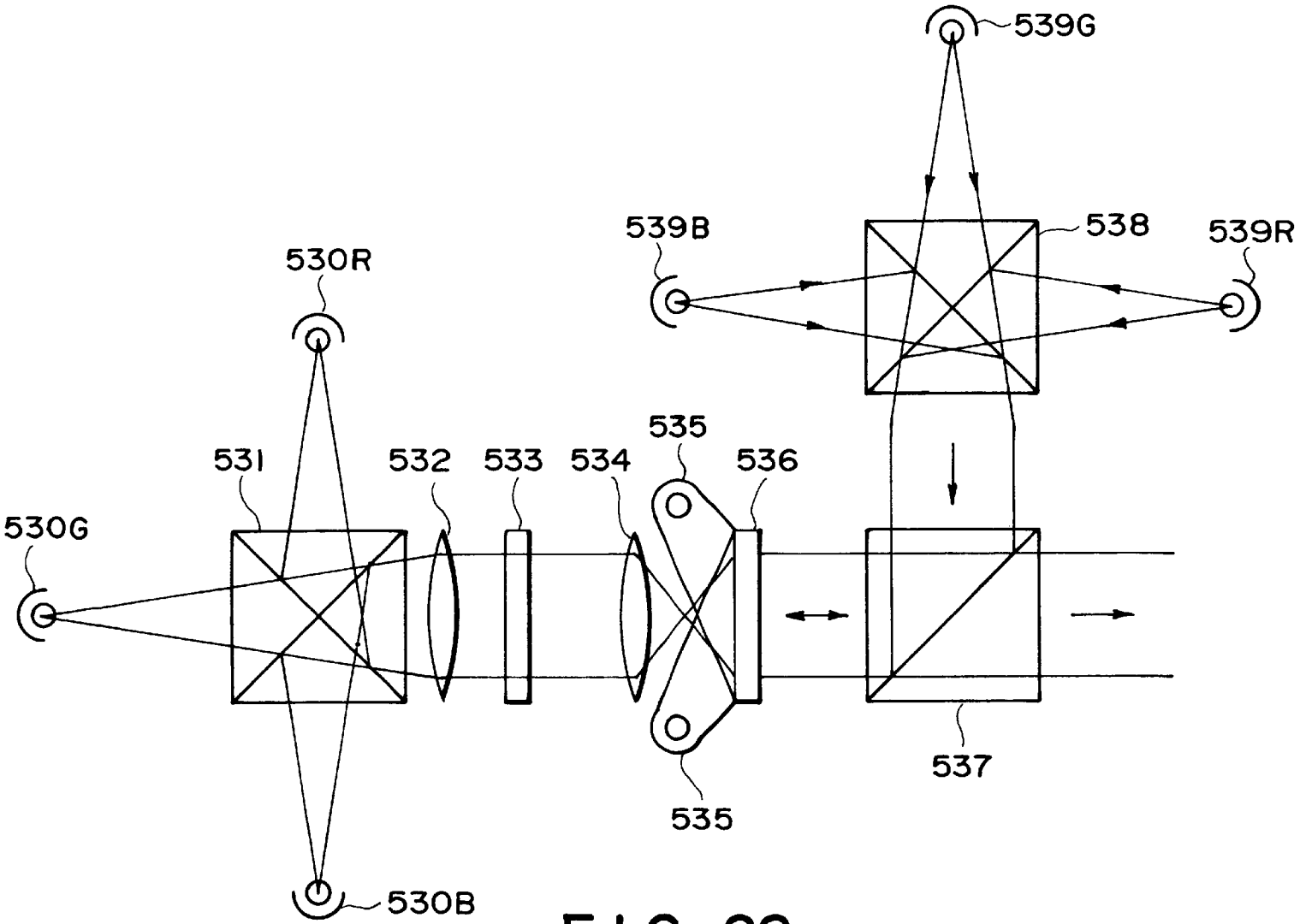
FIG. 22 is a schematic illustration of an embodiment of the image display apparatus.

FIG. 22 is a system diagram of a full-color film viewer as an image display device including a photo-writing type spatial light modulation according to the present invention.

The writing-side light source includes light emitting diodes (LEDs) in three colors of R, G and B.

More specifically, referring to FIG. 22, 530R denotes an R-writing light source LED; 530G, a G-writing light source LED; 530B. a B-writing light source LED; 535, a reset light source; and 531, a three-color mixing prism having an R-reflection surface and a B-reflection surface. The system further includes an optical modulation device, lenses 532 and 534, a film 533, and a prism 537. The system further includes a readout light source system including an R-readout light source LED 539R, a G-readout light source LED 539G, a B-readout light source LED and a three-color mixing prism having an R-reflection surface and a B-reflection surface.

The operation of the system of FIG. 22 will be described with reference to FIG. 23.

Each cycle period is set to be at most ca. 5 msec (=1/flickering frequency/3) The writing light sources 530R, 530G and 530B are sequentially turned on each for one cycle period. On the other hand, the readout light sources 539R, 538G and 539B are sequentially turned on in synchronism with the writing-side light sources. The film 533 carries image data which is assumed to include gradation data represented by transmittances of 0% for R, 50% for G and 100% for B.

During the three cycle periods, additive color mixing is effected to provide a full-color output.

As already described, by changing the lighting time for the readout light sources, the system can be applied to either a positive film or a negative film as the film 533.

If a color filter-equipped transmission-type liquid crystal TV is used in place of the film 533 and in combination with a combination of a halogen lamp and a color-rotation filter as a brighter readout light source, the system may provide a motion picture projector.

Incidentally, in the case of constituting a monochromatic OHP (overhead projector) including monochromatic writing, for example, the reset light can be omitted if the writing light quantity for a specific pixel region is not changed.

It is sufficient if the reset light has at least a certain intensity, so that writing can be performed superposedly in the reset period without problem.

Further embodiments of the present invention will be described with reference to FIGS. 24, et. seq.

The optical system constituting the image display apparatus according to these embodiments is equal to the one shown in FIG. 22, and the optical modulation device is one having a structure as shown in FIG. 18, so that further description thereof will be omitted.

(Sixth Embodiment)

Figure 24:
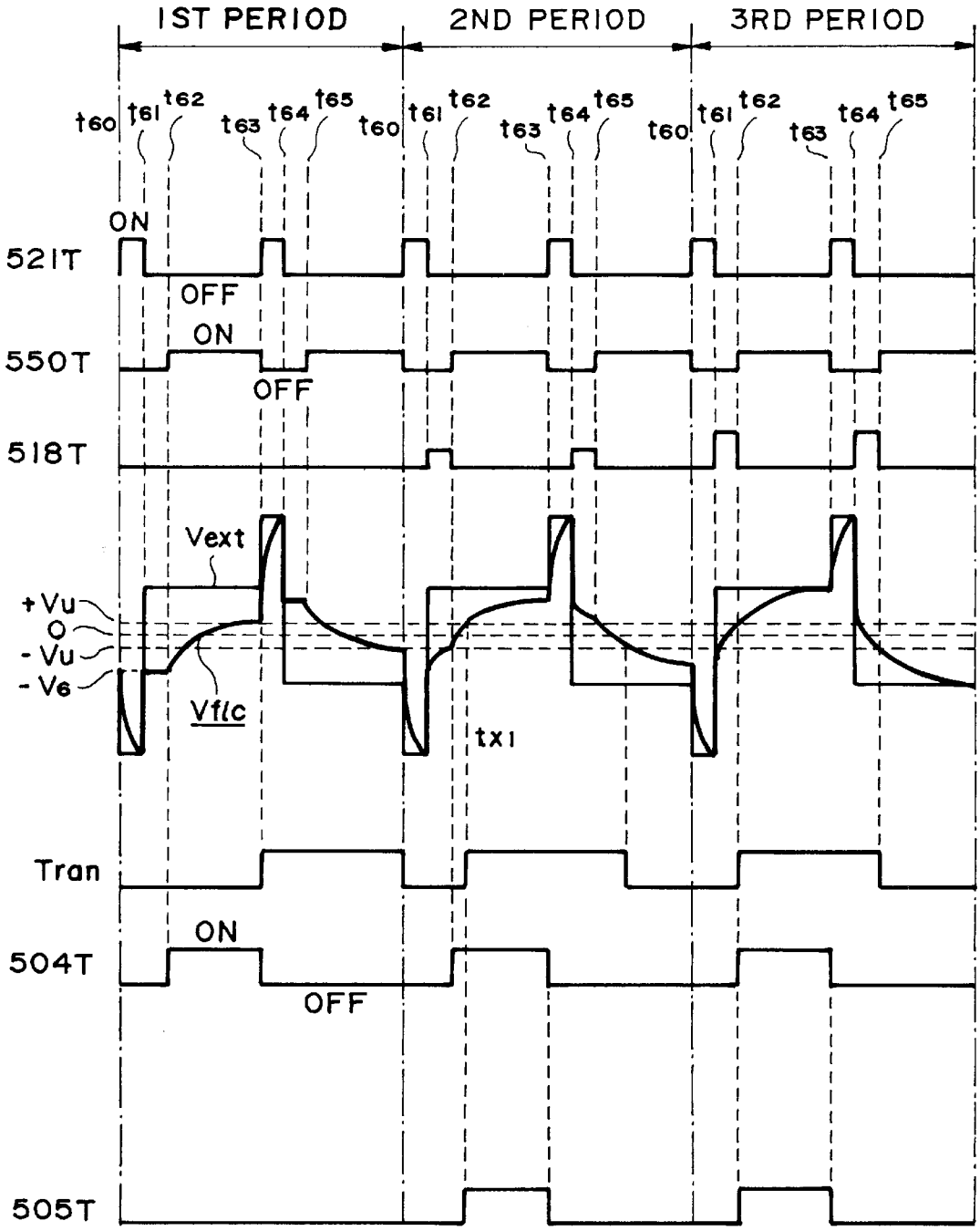

FIG. 24 is a time chart for driving the image display apparatus including the optical modulation device according to this embodiment.

The basic operation is identical to the one in the embodiment of FIG. 21 but different in that the writing light 518T is supplied only in a period of $t_{61}$–$t_{62}$, i.e., a former half of a writing period and turned off in a remaining period (i.e., a latter half of the writing period) in each cycle period. Light supplied in a period of $t_{61}$–$t_{62}$ does not contribute to readout. On the other hand, in a period of $t_{62}$–$t_{63}$, i.e., the latter half of the writing period, uniform bias light 550T is supplied. In case where the writing light 518T carrying gradation data is zero as in a first cycle period, the voltage applied to the liquid crystal is constant at $-V_6$ throughout a period of $t_{61}$–$t_{62}$. Then, when the bias light 550T is supplied at time $t_{62}$, the voltage $V_{flc}$ applied to the liquid crystal is increased in a positive direction due to a lowering in resistance of the photoconductor layer 513. In this embodiment, the value of $R_{PC}$ or $C_{PC}$ (FIG. 6) and time $t_{63}$ are adjusted so that the voltage $V_{flc}$ does not exceed the threshold (+Vu) of the liquid crystal even at the time $t_3$ in case where the writing light is at the minimum level. Accordingly, as the writing light is 0, i.e., at the minimum level, the output light (505T) is also 0, at the minimum level.

In a period of after $t_{63}$ until $t_{60}$ in a subsequent cycle period, the liquid crystal is subjected to an inversion operation by application of an opposite polarity voltage. In this period, no readout light is supplied, so that no image data is reproduced or outputted. In a second cycle period in which the writing light is at a medium level, the photoconductor layer 513 is caused to have a lower resistance, and the liquid crystal is supplied with a voltage higher than $-V_6$ in the positive direction.

In a period of $t_{62}$–$t_{63}$ in the second cycle period, the bias light 550T is similarly supplied, the voltage $V_{flc}$ applied to the liquid crystal is increased from the initial voltage higher than $-V_6$ to exceed the threshold (+Vu) of the liquid crystal at time $t_{x1}$ intermediate within a period of $t_{61}$–$t_{63}$ when the readout light is supplied, unlike in the first cycle period. As a result, the liquid crystal shows a maximum transmittance (Tran) in a period of $t_{x1}$–$t_{63}$, when the readout light is reflected by the reflection layer 514 of the device. Thus, the period for reflection of the readout light ($t_{x1}$–$t_{63}$) is modulated depending on the writing light quantity (518T). The remaining period after time $t_{63}$ is used for the inversion operation similarly as in the first cycle period.

In a third cycle period, a maximum level of writing light is supplied (518T). As a result, the voltage $V_{flc}$ applied to the liquid crystal exceeds the threshold +Vu already at the first time point $t_{62}$ when a period of $t_{62}$–$t_{63}$ for bias light supply is started. Accordingly, during the whole period of $t_{62}$–$t_{63}$ wherein the readout light is supplied, the liquid crystal exhibits a maximum transmittance. As a result, the time integration of the reflected light quantity of the readout light incident to the device and reflected in a prescribed direction becomes maximum.

As described above, the readout light reflection time is determined depending on the writing light quantity so that, if the writing light quantity is changed in an analog manner, the reflection time is changed in an analog manner following the writing light quantity change.

In the period of $t_{63}$–$t_{60}$ for inversion operation in each cycle period, the polarity of the applied voltage $V_{ext}$ is inverted and the writing light and the bias light are supplied in identical light quantities as in the writing period. As a result, the time integration of effective voltage applied to the liquid crystal in one cycle period becomes 0, so that the deterioration of the liquid crystal is suppressed.

In this embodiment, the bias light quantity level may be appropriately determined in view of the time constant of the photoconductor layer 513 and the length of the period of $t_{60}$–$t_{63}$. The light source of the bias light may be identical to or different from the one of the reset light. It is however preferred that the bias light source and the reset light source are respectively provided with a dimmer means so as to allow independent light quantity control.

In this embodiment, a good halftone display free from flickering may become possible if each cycle period is set to ca. 1/30 sec. or shorter and the period of $t_{60}$–$t_{63}$ is set to ca. 1/60 sec. or shorter.

(Seventh Embodiment)

In this embodiment, the above-mentioned Sixth Embodiment is modified so that the readout light source and the writing light source are respectively replaced by independently driven three color light sources of R, G and B, the first cycle period is allotted to writing and readout periods for R, the A, second cycle period is allotted to writing and readout periods for G, and the third cycle period is allotted to writing and readout periods for B, thereby effecting an image reproduction according to full-color optical modulation.

(Eighth Embodiment)

Figure 25:
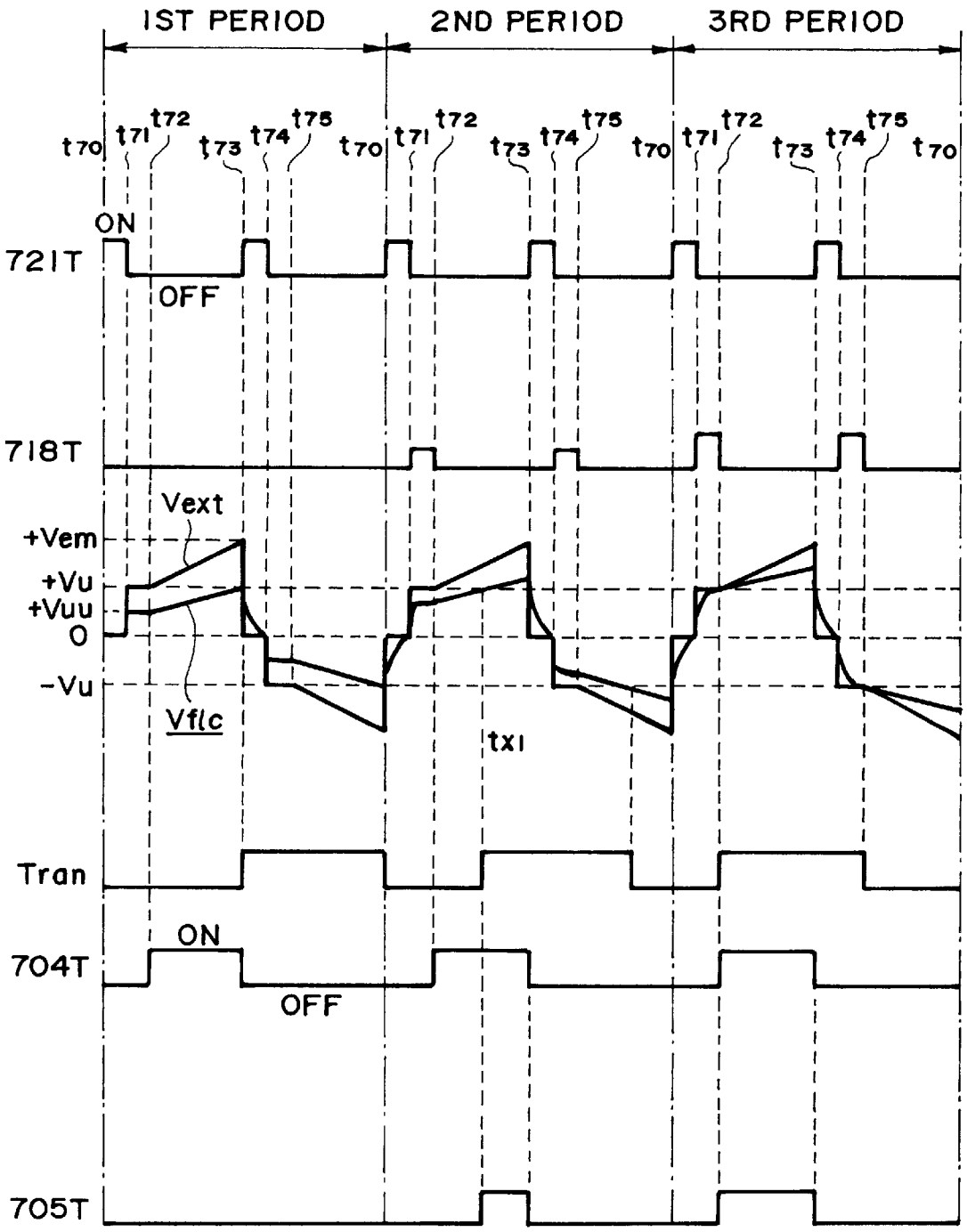

FIG. 25 is a time chart for driving the image display apparatus including the optical modulation device according to this embodiment.

The basic operation is identical to the one in the previous Sixth Embodiment of FIG. 24 but different in that the bias light illumination is replaced by increasing the voltage $V_{ext}$ applied to the device in a period of $t_{72}$–$t_{73}$.

In a period of $t_{70}$–$t_{71}$, reset light is supplied (721T). At this time, $V_{ext}$ is 0.

At time $t_{71}$, $V_{ext}$ is changed to a threshold value +Vu of the liquid crystal but a voltage $V_{flc}$ applied to the liquid crystal becomes a lower voltage +Vuu as the writing light (718T) applied to the photoconductor layer 513 is at a minimum level (=0). In case where the photoconductor layer 513 and the liquid crystal layer 517 have equal capacities, +Vuu becomes equal to Vu/2.

At time $t_{72}$, the writing light (718T) is made 0, and the voltage $V_{ext}$ applied to the device is gradually increased with time up to +Vem at time $t_{73}$. Correspondingly, the voltage $V_{flc}$ applied to the liquid crystal is increased.

In this instance, if +Vem is set to be twice +Vu, $V_{flc}$ is caused to reach +Vu at time $t_{73}$. As a result, in a period of $t_{72}$–$t_{73}$, the liquid crystal does not cause a switching of optical states, thus not showing a maximum transmittance state, while readout light is kept ON (704T).

The remaining period of $t_{73}$–$t_{70}$ is for inversion operation, during which image reproduction is not effected as the readout light is not supplied.

In a second cycle period, a medium level writing light illumination is performed (718T). As a result of the previous inversion operation, the liquid crystal is placed in a non-light-transmissive state at time $t_{70}$. As $V_{ext}$=0, $V_{flc}$ approaches a voltage level of 0.

At time $t_{71}$, $V_{ext}$ is made equal to the threshold +Vu, and the readout light is turned on (704T). As a result of the application of $V_{ext}$, $V_{flc}$ is increased but does not reach the threshold +Vu.

At time $t_{72}$, $V_{ext}$ begins to increase, so that $V_{flc}$ increases correspondingly to exceed the threshold +Vu at time $t_{x1}$, when the liquid crystal is switched to an optical state showing a maximum transmittance. Accordingly, at this time $t_{72}$, the readout light already turned on is allowed to be incident to the reflection layer 514 through the liquid crystal layer 517 and reflected thereat to provide a recognizable reflected image. Thus, the reflection time $t_{x1}$–$t_{73}$ is modulated depending on the writing light quantity. A period after time $t_{73}$ is for the inversion operation.

In a third cycle period, the writing light is supplied at a maximum light quantity level. The operation in a period of $t_{70}$–$t_{71}$ is identical to the one in the first and second cycle periods described above.

As a result of illumination with a writing light started at time $t_{71}$, $V_{flc}$ reaches the threshold +Vu at time $t_{72}$. Accordingly, during a readout light lighting period of $t_{72}$–$t_{73}$, the liquid crystal is held in an optical state of a maximum transmittance, so that the readout light is reflected by the device for a maximum period (705T).

As described above, the readout light reflection time is determined depending on the writing light quantity so that, if the writing light quantity is changed in an analog manner, the reflection time is changed in an analog manner following the writing light quantity change.

In the period of $t_{73}$–$t_{70}$ for inversion operation in each cycle period, the polarity of the applied voltage $V_{ext}$ is inverted and the writing light and the bias light are supplied in identical light quantities as in the writing period. As a result, the time integration of effective voltage applied to the liquid crystal in one cycle period becomes 0, so that the deterioration of the liquid crystal is suppressed.

In this embodiment, the rate of $V_{ext}$ change with time may be appropriately determined in view of the time constant of the photoconductor layer 513 and the length of the period of $t_{71}$–$t_{73}$.

In this embodiment, a good halftone display free from flickering may become possible if each cycle period is set to ca. 1/30 sec. or shorter and the period of $t_{70}$–$t_{73}$ is set to ca. 1/60 sec. or shorter.

(Ninth Embodiment)

In this embodiment, the above-mentioned Eighth Embodiment is modified so that the readout light source and the writing light source are respectively replaced by independently driven three color light sources of R, G and B, the first cycle period is allotted to writing and readout periods for R, the second cycle period is allotted to writing and readout periods for G, and the third cycle period is allotted to writing and readout periods for B, thereby effecting an image reproduction according to full-color optical modulation.

(Tenth Embodiment)

Figure 26:
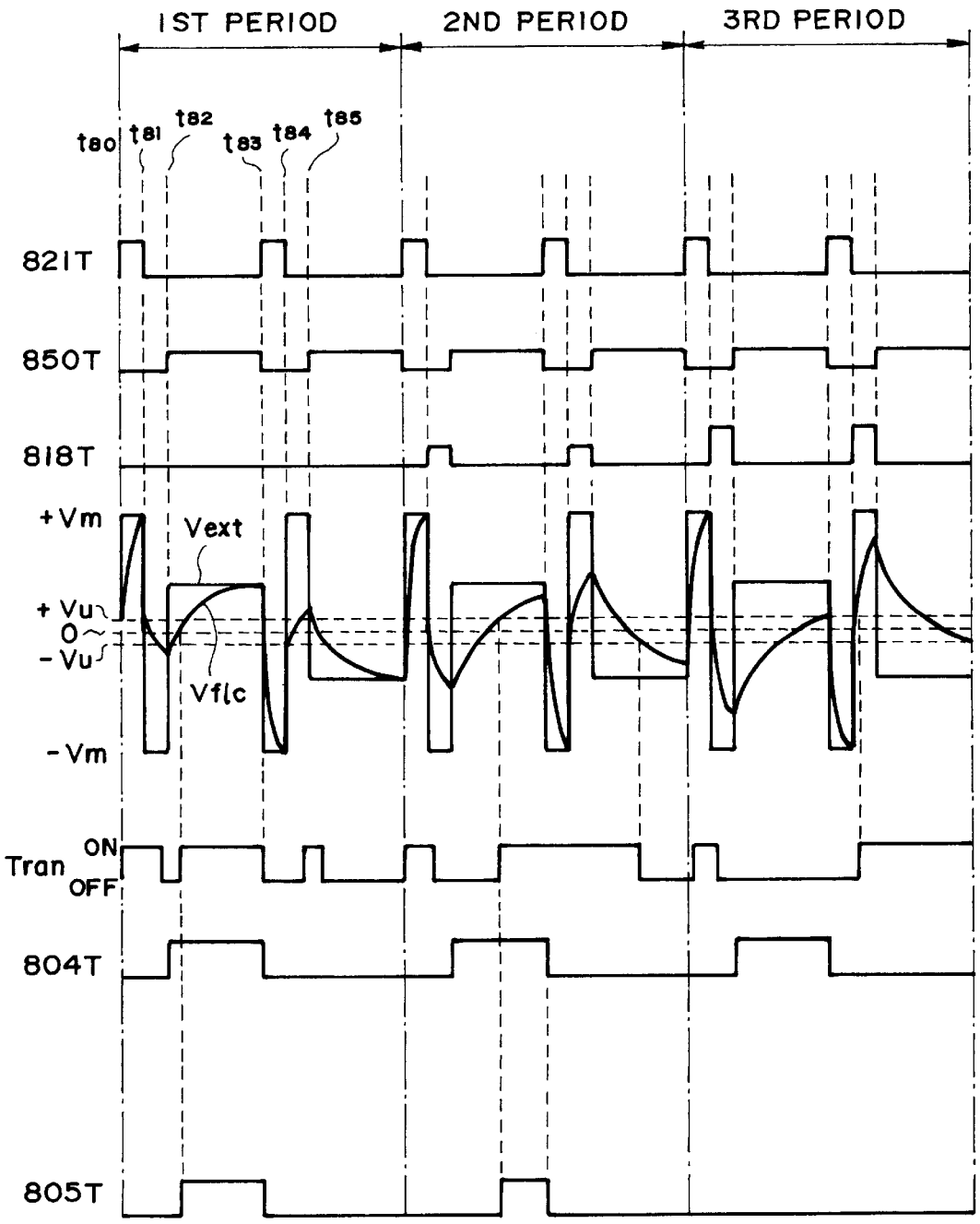

FIG. 26 is a time chart for driving the image display apparatus including an optical modulation device according to another embodiment of the present invention.

Figure 23:
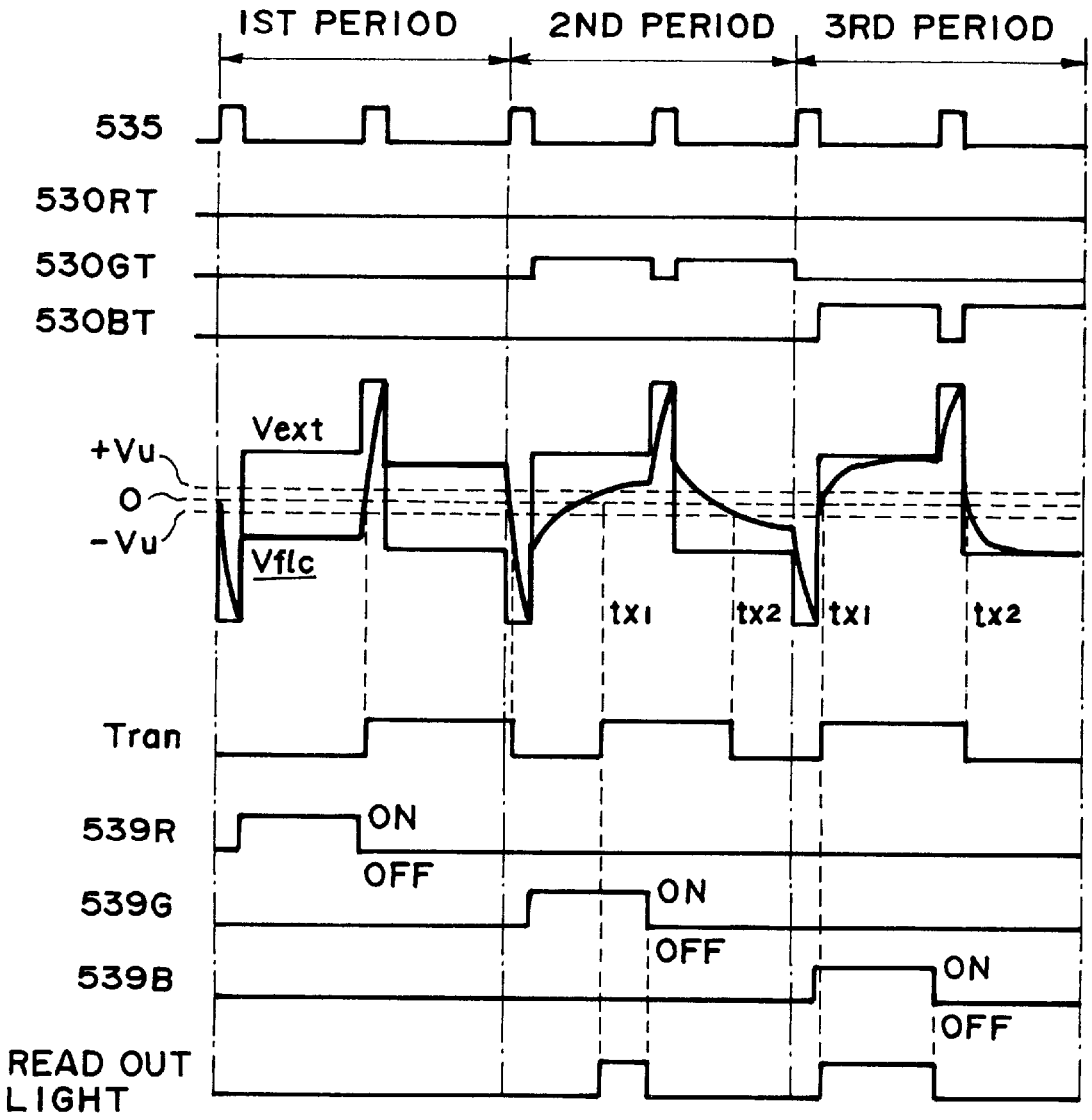
FIGS. 23–28 are respectively a time chart for illustrating an operation of an image forming apparatus according to an embodiment of the invention.

For easy understanding of a manner of duty modulation of readout light depending on light signals carrying gradation data, first to third cycle periods are presented for supplying three light quantity levels of writing light similarly as in the embodiments of FIGS. 23, 24 and 25.

In a period $t_{80}$–$t_{81}$ in a first cycle period, a photoconductor layer 513 of the device is illuminated with reset light. At this time, as a reset pulse having a positive maximum peak value +Vm is applied between a pair of electrodes 512 and 515. the liquid crystal 517 is supplied with a voltage increasing in accordance with the time constant of the device. At time $t_{81}$, the reset light is turned off and a first writing pulse having a negative maximum peak value −Vm is started to be applied between the electrodes of the device. The first writing pulse is applied for a period of $t_{81}$–$t_{82}$ in a former half of a writing period.

In the first cycle period, a lowest gradation level of writing light (818T) is supplied and, in a period of $t_{81}$–$t_{82}$, the liquid crystal is supplied with a voltage which does not reach −Vm but exceeds a negative threshold −Vu, so that the liquid crystal is placed in an optical state of OFF (Tran).

In a period $t_{82}$–$t_{83}$ as a latter half of the writing, a second writing pulse is applied ($V_{ext}$) but no writing light is supplied (818T). Instead thereof, bias light (850T) not depending on gradation data is supplied to the photoconductor layer so that the voltage $V_{flc}$ applied to the liquid crystal layer is raised at a larger speed. As the voltage $V_{flc}$ exceeds the threshold +Vu, the liquid crystal is switched into an optical state of ON, which is retained until the liquid crystal is switched OFF at time $t_{83}$ when $V_{flc}$ is changed toward −Vm by reset voltage application and reset light illumination. During this period, the liquid crystal is placed in a transmission state, thus in a reflection state of the device. The readout light (804T) is turned on a little earlier than time $t_{82}$ and kept on at least until time $t_{83}$.

As a result, within a time period of $t_{82}$–$t_{83}$, an overlapping time (805T) between the liquid crystal ON-time (Tran) and the lighting time of readout light source (804T) is subjected to analog duty modulation depending on the gradation data. In this embodiment of FIG. 26, a maximum gradation level of modulated readout light, i.e., output light (805T) is attained at a minimum level of writing light (818T) so that the gradation levels of the writing light and the output light are inverted with each other.

In this embodiment, in a period $t_{81}$–$t_{82}$ for applying a maximum peak value (−Vm), light data is written (818T). In the period $t_{81}$–$t_{82}$, a high external voltage $V_{ext}$ is applied to the device and accordingly a high voltage is applied across the photoconductor layer. In this case, a large change in voltage applied to the liquid crystal can be caused when light is incident to the photoconductor layer. As a result, the modulatable voltage range is enlarged, so that it becomes easy to increase the number of gradation levels.

Also in this embodiment, similarly as in the other embodiments, the voltage $V_{ext}$ applied to the device is subjected to positive-negative polarity inversion between a former half period (i.e., modulation period) ($t_{80}$–$t_{83}$) and a latter half period (DC-canceling period) (after $t_{83}$), so as to provide a DC component of zero. Further, the reset light (821T), bias light (850T) and writing light (818T) are applied to the device also in a latter half of each cycle period similarly as in the former half period. The respective lights supplied in the latter half are dummy lights not directly contributing to optical modulation but function to provide the voltage $V_{flc}$ applied to the liquid crystal with a positive-negative symmetry, thus making the net DC component substantially zero.

Similarly as in some previous embodiments, if the readout light illumination period is placed in a latter half of each cycle period, the former half ($t_{80}$–$t_{83}$) becomes a DC-canceling period, and the latter half (after $t_{83}$) becomes a modulation period.

The quantities of the reset light and the bias light, and the applied voltage level ($V_{ext}$), etc., may preferably be adjusted appropriately in view of factors, such as the species and properties of the constituent materials, the thickness of the liquid crystal and the photoconductor or photoelectric conversion substance layer, and the structure of the optical modulation device. In case of simplifying the system, the reset light and bias light may be omitted by appropriately determining the peak values of the respective pulses of the applied voltage $V_{ext}$, (Eleventh Embodiment)

Figure 27:
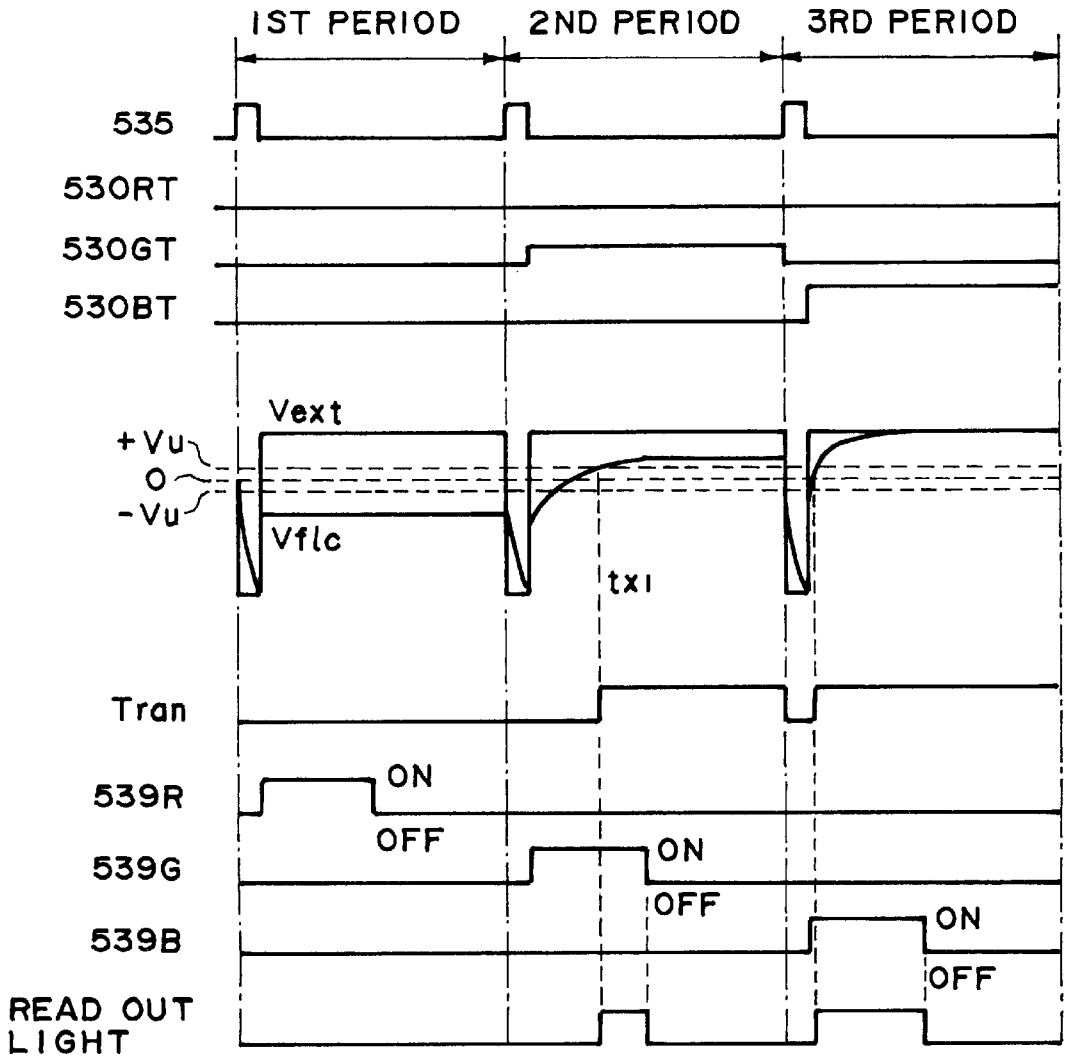

FIG. 27 is a time chart for driving the image display apparatus including an optical modulation device according to another embodiment of the present invention.

At the beginning of a first cycle period, a photoconductor layer 513 is illuminated with reset light (535) and a negative reset pulse is applied to the device as an external voltage, whereby the optical modulation substance layer 517 is placed in a non-light-transmissive state.

Then, an external positive writing pulse $V_{ext}$ is applied to the device but, as the light data quantity is at a minimum level (530RT), an effective voltage $V_{flc}$ applied to the optical modulation substance does not exceed a positive threshold +Vu. As a result, even if red light (539R) is turned on, no output light is effectively read out as shown at the lowest part in FIG. 27.

At the beginning of a second cycle period, similarly as in the first cycle period, a negative reset pulse is applied in synchronism with reset light (535) Then. together with a writing pulse $V_{ext}$, a medium level light quantity data (530GT) is applied to the photoconductor layer, so that the voltage $V_{flc}$ applied to the optical modulation substance is gradually increased to exceed the threshold +Vu at time $t_{x1}$, when the optical modulation substance is switched to a light transmissive state, whereby green illumination light (539G) is effectively read out.

In a third cycle period for reading out blue light (539R), a maximum level writing light is applied (530BT), so that the voltage $V_{flc}$ applied to the optical modulation substance exceeds a threshold +Vu immediately after resetting. As a result, a maximum level of blue light is read out.

In the embodiment shown in FIG. 27, the time of turning on the respective colors of light sources (539R, 539G and 539B) is synchronized with the time of starting the writing pulse application, but the light source turning-on time can be placed in the reset period.

The time of turning off the respective color light sources may be set to a time point at which $V_{flc}$ reaches the threshold (+Vu) at the latest by a minimum writing light data quantity when supplied in superposition with a writing voltage pulse $V_{ext}$. More specifically, if the light quantity level of 530GT in the second cycle period in FIG. 27 is assumed to be the minimum level of light quantity for causing the voltage $V_{flc}$ applied to the optical modulation substance to reach the threshold +Vu, the time point for turning off the light source (539G) should be set at time $t_{x1}$. However, if somewhat inferior linearly can be tolerated, the turning-off time can be deviated to some extent.

(Twelfth Embodiment)

Figure 28:
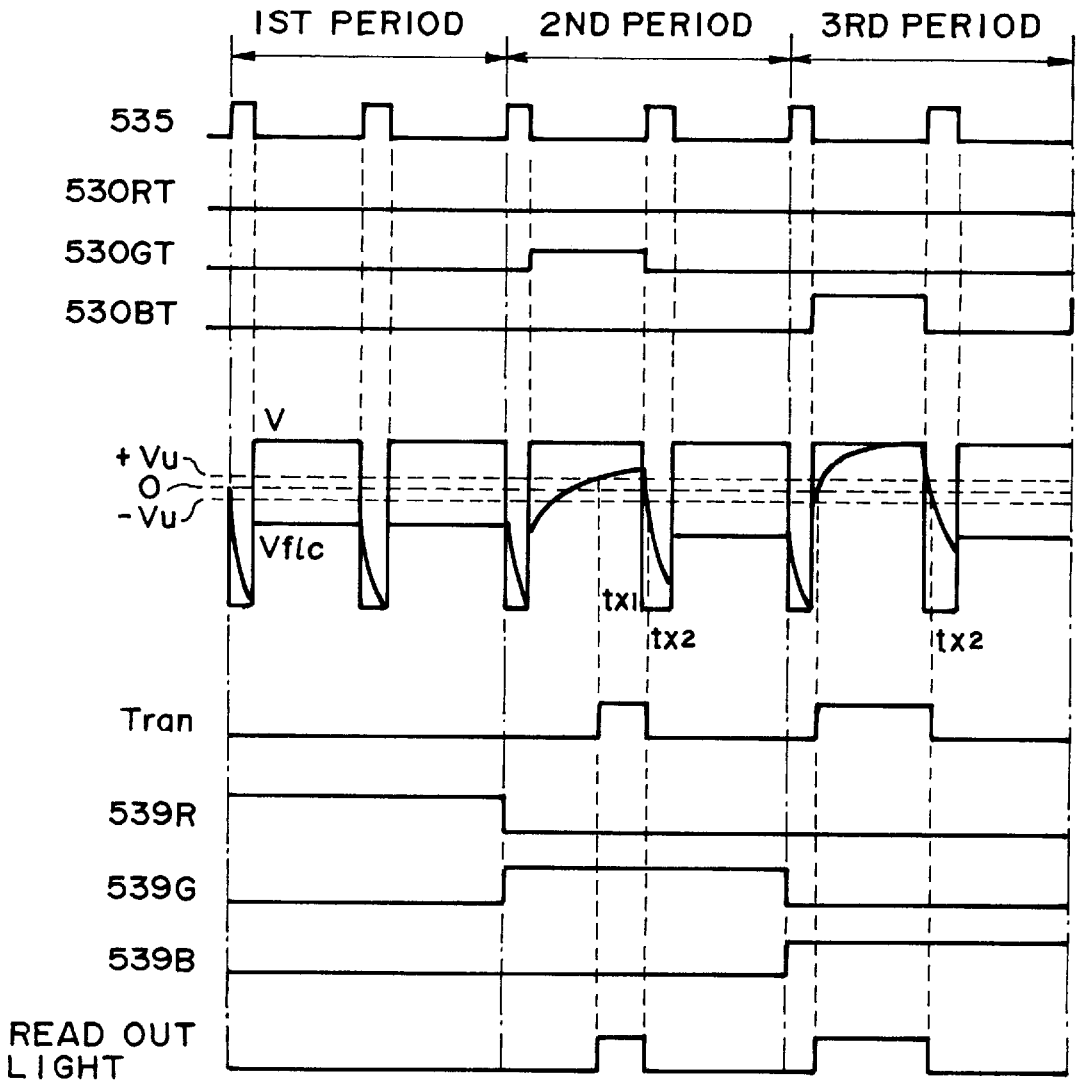

FIG. 28 is a time chart for driving the image display apparatus including an optical modulation device according to another embodiment of the present invention.

This embodiment is different from the embodiment of FIG. 27 in that each color readout light source (539R, 539G, 539B) is continuously energized for the entirety of an associated cycle period, the reset and writing are performed in a former half of each cycle period, and a latter half is used for resetting and dummy writing.

By resetting after writing, the optical state of the optical modulation substance is forcibly returned to the original state, whereby halftone light data can be readout even if the lighting duty of each light source in each cycle period is set to be 1 (100%).

The time for initiating the second resetting in each cycle period should be set similarly as the light source turning-off time described in the embodiment of FIG. 27.

In either embodiment of FIGS. 27 and 28, each cycle period may preferably be set to 1/30 sec. or shorter. In case of processing monochromatic data, a single color light source may be used instead of three color light sources.

What is claimed is:

1. A driving method for an optical modulation unit including a light source periodically turned on and optical modulation means including an optical modulation element that is periodically turned on, said driving method comprising the step of:

changing an amplitude of a voltage applied to the optical modulation element depending on given gradation data so as to modulate an overlapping time between an ON period of the optical modulation means and a lighting period of the light source in order to effect an analog duty-modulated gradational display scheme.

2. A driving method according to claim 1, wherein the voltage applied to the optical modulation means is changed with time.

3. An optical modulation apparatus, comprising:

a light source periodically turned on;

optical modulation means including an optical modulation element that is periodically turned on; and drive means for driving said optical modulation means by changing an amplitude of a voltage applied to the optical modulation element depending on given gradation data so as to modulate an overlapping time between an ON period of said optical modulation means and a lighting period of said light source in order to effect an analog duty-modulated gradational display scheme.

4. An apparatus according to claim 3, wherein said drive means includes means for changing the voltage applied to the optical modulation element with time.

5. An apparatus according to claim 3, wherein said drive means includes means for applying a drive voltage to said optical modulation means, and means for changing the drive voltage with time.

6. An apparatus according to claim 3, wherein said drive means includes a capacitance element and a resistance element for modulating the overlapping time.

7. An apparatus according to claim 3, wherein the optical modulation element comprises a liquid crystal that has two optical states.

8. An apparatus according to claim 3, wherein the optical modulation element comprises a chiral smectic liquid crystal.

9. An apparatus according to claim 3, wherein the optical modulation element comprises one of a ferroelectric and an anti-ferroelectric liquid crystal.

10. An apparatus according to claim 3, wherein said light source is a white light source.

11. An apparatus according to claim 3, wherein said light source includes a red light source, a blue light source, a green light source, and lighting means for energizing the red, blue, and green light sources in mutually different periods.

12. An apparatus according to claim 3, wherein the gradation data is carried by light data.

13. A driving method for an optical modulation unit including a light source periodically turned on and optical modulation means comprising a plurality of optical modulation elements arranged in a plane, wherein each of the optical modulation elements is periodically turned on, said driving method comprising the step of:

changing an amplitude of a voltage applied to an optical modulation element depending on given gradation data so as to modulate an overlapping time between an ON period of the optical modulation element and a lighting period of the light source in order to effect an analog duty-modulated gradational display scheme.

14. A driving method for an optical modulation unit including a light source periodically turned on and optical modulation means comprising a planar optical modulation element that is periodically turned on, said driving method comprising the step of:

changing an amplitude of a voltage applied to a local region of the planar optical modulation element depending on given gradation data so as to modulate an overlapping time between an ON period of the optical modulation element and a lighting period of the light source in order to effect an analog duty-modulated gradational display scheme.

15. A driving method for an optical modulation unit including optical modulation means comprising a pair of electrodes, and a photoelectric conversion layer and an optical modulation element disposed between the pair of electrodes, a signal light source for supplying light data carrying gradation data to the photoelectric conversion layer, and a readout light source for supplying readout light to the optical modulation element, said driving method comprising the step of:

controlling a lighting time of the readout light source to modulate an overlapping time between a period when the optical modulation element assumes a prescribed optical state and the lighting time depending on given gradation data in order to effect an analog duty-modulated gradational display scheme.

16. A driving method for driving an optical modulation unit including a light source and optical modulation means comprising an optical modulation element, said driving method comprising the steps of:

applying to the optical modulation element a voltage with an amplitude that changes with time depending on given gradation data, thereby modulating a timing when the optical modulation element is switched from a first optical state to a second optical state; and turning on the light source to obtain light data subjected to analog duty modulation depending on the gradation data in order to effect an analog duty-modulated gradational display scheme.

17. A driving method for an optical modulation unit including a light source and optical modulation means comprising an optical modulation element that assumes bistable states, a photoelectric conversion substance, and a pair of electrodes sandwiching the optical modulation element and the photoelectric conversion substance, said driving method comprising the steps of:

applying a voltage between the pair of electrodes, and supplying to the optical modulation element light data carrying gradation data to the photoelectric conversion substance so as to apply a voltage having an amplitude that changes with time depending on the gradation data, thereby modulating a period between switching from a first stable state to a second stable state to switching from the second stable state to the first stable state, respectively, of the optical modulation element, the period being modulated within a range having a maximum set to be shorter than a prescribed period so as to allow recognition of a change in gradation level, in order to effect an analog duty-modulated gradational display scheme.

18. A driving method for an optical modulation unit including a light source and optical modulation means comprising an optical modulation element, a photoelectric conversion substance, and a pair of electrodes sandwiching the optical modulation element and the photoelectric conversion substance, said driving method comprising the steps of:

applying a voltage between the pair of electrodes, supplying to the optical modulation element light data carrying gradation data to the photoelectric conversion substance so as to apply a voltage with an amplitude that changes with time depending on the gradation data, thereby modulating a timing of switching from a first optical state to a second optical state in an analog manner; and turning on the light source so as to provide a lighting time within a range having a maximum period set to be shorter than a prescribed period so as to allow recognition of a change in gradation level in order to effect an analog duty-modulated gradational display scheme.

19. A driving method for an optical modulation unit including a light source and optical modulation means comprising an optical modulation element, a photoelectric conversion substance, and a pair of electrodes sandwiching the optical modulation element and the photoelectric conversion substance, said driving method comprising the steps of:

repetitively applying a voltage between the pair of electrodes, the voltage causing a polarity inversion and having a DC component of substantially zero within a prescribed period;

supplying light data carrying gradation data to the photoelectric conversion substance; and applying to the optical modulation element a voltage with an amplitude that changes with time depending on the gradation data to the optical modulation element to modulate a timing of switching from a first optical state to a second optical state, thereby turning on the light source in either a former half or a latter half of the prescribed period, in order to effect an analog duty-modulated gradational display scheme.

20. A driving method according to claim 16, wherein the optical modulation means comprises a pair of electrodes between which the optical modulation element and a photoelectric conversion substance are disposed.

21. A driving method according to any of claims 15–19, wherein the optical modulation means comprises a pair of electrodes with an optical modulation substance and a non-single crystal semiconductor disposed between the electrodes.

22. A driving method according to any of claims 15–19, wherein the optical modulation means comprises a pair of electrodes with a chiral smectic liquid crystal and a non-single crystal semiconductor disposed between the electrodes.

23. A driving method according to any of claims 15–19, wherein the optical modulation means comprises a pair of electrodes with a chiral nematic liquid crystal substance and a non-single crystal semiconductor disposed between the electrodes.

24. A driving method according to any of claims 15–19, wherein the optical modulation means comprises a pair of electrodes with a ferroelectric liquid crystal and a photoelectric conversion substance disposed between the electrodes.

25. A driving method according to any of claims 15–19, wherein the optical modulation means comprises a pair of electrodes with an optical modulation substance and a non-single crystal silicon material disposed between the electrodes.

26. A driving method according to any of claims 15–19, wherein the optical modulation means comprises a pair of electrodes with a chiral smectic liquid crystal and a non-single crystal silicon-germanium material disposed between the electrodes.

27. A driving method according to any of claims 15–19, wherein the light source is turned on in synchronism with a commencement of application of a writing voltage after a resetting operation.

28. A driving method according to any of claims 15–19, wherein the light source is turned off before switching from the second optical state to the first optical state.

29. A driving method according to any of claims 15–19, wherein the light source is energized only for a period corresponding to a modulation range of timing when the optical modulation element is switched from the first optical state to the second optical state.

30. A driving method according to any of claims 15–19, wherein when the gradation data corresponds to a minimum or maximum gradation level the light source is turned on in synchronism with a commencement of application of a writing voltage after a resetting operation and is turned off prior to switching from the first optical state to the second optical state.

31. A driving method according to any of claims 15–19, wherein when the gradation data corresponds to a minimum or maximum gradation level the light source is turned on in synchronism with a commencement of application of a writing voltage after a resetting operation and is turned off prior to switching from the second optical state to the first optical state.

32. A driving method according to any of claims 15–19, wherein the light source is repetitively turned on at a cycle period shorter than a flickering frequency cycle period.

33. A driving method according to any of claims 15–19, wherein the light source emits mutually different wavelengths of light sequentially and selectively at a cycle period shorter than a flickering frequency cycle period.

34. A driving method according to any of claims 16–19, wherein the voltage applied to the optical modulation element is polarity-inverted to provide a DC component of substantially zero within a prescribed period, and the light source is energized for a lighting period shorter than the prescribed period.

35. A driving method according to any of claims 17–19, wherein the prescribed period or continuous lighting period of the light source is at most 1/30 sec.

36. A driving method according to any of claims 17–19, wherein the prescribed period or continuous lighting period of the light source is at most 1/60 sec.

37. A driving method according to any of claims 17–19, wherein the prescribed period or continuous lighting period of the light source is at most 1/90 sec.

38. A driving method according to any of claims 17–19, wherein the prescribed period or continuous lighting period of the light source is at most 1/180 sec.

39. A driving method according to any of claims 13–19, wherein the light source comprises a white light source.

40. A driving method according to any of claims 13–19, wherein the light source is one that successively emits red light, green light, and blue light.

41. A driving method according to any of claims 16–19, wherein the voltage applied to the optical modulation element is a voltage that causes a polarity inversion and that has a DC component of substantially zero within a prescribed period.

42. A driving method according to any of claims 16–19, wherein the voltage applied to the optical modulation element is a voltage that causes a polarity inversion and that has a DC component of substantially zero within a prescribed period, and the voltage is applied in a cycle period shorter than a flickering frequency cycle period.

43. A driving method according to any of claims 13–19, wherein a reset voltage is applied to the optical modulation means.

44. A driving method according to any of claims 13, 14, and 16–19, wherein the optical modulation means is reset and then is illuminated with light data carrying gradation data in synchronism with a writing voltage applied to the optical modulation means thereby to be supplied with the voltage with an amplitude that changes with time.

45. A driving method according to any of claims 13–19, wherein the optical modulation means is reset and then is illuminated with light data carrying gradation data in synchronism with a voltage having a maximum peak value in a period for applying a writing voltage to the optical modulation means.

46. A driving method according to any of claims 13–19, wherein the optical modulation means is reset and then is illuminated with light data carrying gradation data only for an initial period within a period for applying a writing voltage to the optical modulation means.

47. A driving method according to any of claims 13–19, wherein the optical modulation means is reset then is illuminated with light data carrying gradation data only for an initial period within a period for applying a writing voltage to the optical modulation means, and thereafter the writing voltage applied to the optical modulation means is gradually changed.

48. A driving method according to any of claims 13–19, wherein the optical modulation means is supplied with light data carrying the gradation data and bias light not depending on the gradation data.

49. A driving method according to any of claims 13–19, wherein the optical modulation means is supplied with light data carrying the gradation data and then is supplied with bias light not depending on the gradation data.

50. A driving method according to any of claims 13–19, wherein the optical modulation means is supplied with a reset voltage prior to illumination with the light data carrying the gradation data.

51. A driving method according to any of claims 13–19, wherein the optical modulation means is supplied with a reset voltage prior to illumination with the light data carrying the gradation data, and is further illuminated with bias light.

52. A driving method according to any of claims 15–19, wherein the optical modulation means is illuminated with the light data carrying the gradation data for a period different from the lighting period of the light source.

53. A driving method according to any of claims 16–19, wherein the optical modulation means is supplied with a first the voltage simultaneously with illumination with the light data carrying the gradation data, and is then supplied with a second voltage different from first the voltage after the illumination.

54. A driving method according to any of claims 1, 13, 14 and 15, wherein the overlapping time is modulated within a range up to a maximum duty of at most ½.

55. A driving method according to any of claims 1, 13, 14 and 15, wherein the overlapping time for each of a plurality of colors is modulated within a range up to a maximum duty of at most ⅙.

56. A driving method according to any of claims 1, 13, 14 and 15, wherein the optical modulation element comprises a reflecting member capable of changing its reflecting surface direction.

57. A driving method for an image display unit including an optical modulation device comprising a pair of electrodes for application of a voltage therebetween, and a photoconductor layer and an optical modulation element disposed between the pair of electrodes, a signal light source for supplying light information carrying gradation data to the photoconductor layer, and a readout light source for supplying readout light for reading out image data to the optical modulation element, said driving method comprising the step of:

operating the readout light source in a lighting period controlled to be different from a period of supplying the light information, thereby modulating an overlapping time between a period in which the optical modulation element assumes a prescribed optical state and the lighting period depending on the gradation data in order to effect an analog duty-modulated gradational display scheme.

58. A method according to any one of claims 1, 13, 14, and 16–19, wherein a pulse width in addition to the amplitude of the voltage is changed depending on the given gradation data.

59. An apparatus according to claim 3, wherein a pulse width in addition to the amplitude of the voltage is changed depending on the given gradation data.

60. An apparatus according to claim 3, wherein said drive means includes a parallel circuit comprising a capacitance element $C_{PC}$ and a resistance element disposed in parallel with a capacitance $C_{LC}$ of said optical modulation means so as to provide a variable discharge time determined by a time constant of the parallel circuit and depending on the given gradation data.

61. A method according to claim 18, wherein the optical modulation element is driven in a succession of cycle periods so that the optical modulation element is placed in the first and second optical states for equal periods within each cycle period.

62. A method according to claim 61, wherein the optical modulation element comprises one of a ferroelectric and an anti-ferroelectric liquid crystal.

* * * * *

UNITED STATES PATENT AND TRADEMARK OFFICE

CERTIFICATE OF CORRECTION

PATENT NO. : 6,037,922
DATED : March 14, 2000
INVENTOR(S): MINETO YAGYU

It is certified that error appears in the above-identified patent and that said Letters Patent is hereby corrected as shown below:

ON THE TITLE PAGE:

[57] ABSTRACT,

Line 6, "graduation" should read --graduation--.

COLUMN 1:

Line 43, "et al" should read --et al.--

COLUMN 2:

Line 37, "graduation" should read --gradation--; and
Line 48, "graduation" should read --gradation--.

COLUMN 3:

Line 32, "electrode" should read --electrodes--; and
Line 51, "electrode" should read --electrodes--.

COLUMN 4:

Line 3, "electrode" should read --electrodes--.

COLUMN 5:

Line 43, "system" should read --a system--.

UNITED STATES PATENT AND TRADEMARK OFFICE

CERTIFICATE OF CORRECTION

PATENT NO. : 6,037,922
DATED : March 14, 2000
INVENTOR(S) : MINETO YAGYU

It is certified that error appears in the above-identified patent and that said Letters Patent is hereby corrected as shown below:

COLUMN 6:

Line 33, "of " should read --of a --.

COLUMN 7:

Line 15, "and the" should read --the--; and
Line 26, "subslides" should read --subsides--.

COLUMN 8:

Line 8, "my" should read --may--.

COLUMN 9:

Line 25, "my" should read --may--;
Line 54, "a" should be deleted; and
Line 61, "substrate" should read --substrates--.

COLUMN 10:

Line 12, "constitutes" should read --constitute--.

COLUMN 13:

Line 14, "case case" should read --each case--; and
Line 51, "an" should read --a--.

UNITED STATES PATENT AND TRADEMARK OFFICE

CERTIFICATE OF CORRECTION

PATENT NO. : 6,037,922
DATED : March 14, 2000
INVENTOR(S) : MINETO YAGYU

It is certified that error appears in the above-identified patent and that said Letters Patent is hereby corrected as shown below:

COLUMN 18:

Line 38, "the A," should read --the--.

COLUMN 20:

Line 9, "515." should read --515,--.

COLUMN 21:

Line 15, "$V_{ext}$," should read -- $V_{ext}$,--; and
Line 34, "(535) Then." should read --(535) . Then, --.

COLUMN 26:

Line 40, "then" should read --then--.

UNITED STATES PATENT AND TRADEMARK OFFICE

CERTIFICATE OF CORRECTION

PATENT NO. :6,037,922
DATED :March 14, 2000
INVENTOR(S) :MINETO YAGYU

It is certified that error appears in the above-identified patent and that said Letters Patent is hereby corrected as shown below:

COLUMN 27:

Line 3, "the voltage" should read --voltage--; and
Line 5, "first the" should read --the first--.

Signed and Sealed this

Fifth Day of June, 2001

Nicholas P. Godici

NICHOLAS P. GODICI

*Acting Director of the United States Patent and Trademark Office*

*Attest:*

*Attesting Officer*